US007670121B2

(12) United States Patent
Weatherbee

(10) Patent No.: US 7,670,121 B2
(45) Date of Patent: Mar. 2, 2010

(54) SPHERICAL FLUID MACHINES

(76) Inventor: Paul Weatherbee, 4025 Cougar Way, Abilene, TX (US) 79606-2329

( * ) Notice: Subject to any disclaimer, the term of this patent is extended or adjusted under 35 U.S.C. 154(b) by 0 days.

(21) Appl. No.: 11/893,851

(22) Filed: Aug. 18, 2007

(65) Prior Publication Data

US 2008/0031757 A1 Feb. 7, 2008

Related U.S. Application Data

(62) Division of application No. 10/784,709, filed on Feb. 23, 2004, now abandoned.

(51) Int. Cl.
*F01C 3/00* (2006.01)
*F03C 2/00* (2006.01)

(52) U.S. Cl. ..... 418/68; 418/1; 418/16

(58) Field of Classification Search ..... 418/1, 418/16, 22, 53, 58, 68, 101, 209
See application file for complete search history.

(56) References Cited

U.S. PATENT DOCUMENTS

| | | | |
|---|---|---|---|
| 168,034 | A | 9/1875 | Lyon |
| 826,985 | A | 7/1906 | Appel |
| 1,678,050 | A | 7/1928 | Kearney |
| 1,946,343 | A | 2/1934 | Wicha |
| 1,967,167 | A | 7/1934 | Weis |
| 2,043,544 | A | 6/1936 | Kempthorne |
| 2,708,413 | A | 5/1955 | Loewen |
| 3,492,974 | A | 2/1970 | Kreimeyer |
| 4,441,869 | A | 4/1984 | Larsen |
| 4,938,025 | A | 7/1990 | Larsen |
| 5,147,193 | A | 9/1992 | Larsen |
| 5,199,864 | A | 4/1993 | Stecklein |
| 6,241,493 | B1 | 6/2001 | Turner |
| 6,442,935 | B1 | 9/2002 | Larsen |

*Primary Examiner*—Theresa Trieu
(74) *Attorney, Agent, or Firm*—Michael A. Ervin; M.A. Ervin & Associates

(57) ABSTRACT

A rotary fluid machine, such as a pump or motor has a housing with a spherical interior in which primary and secondary vanes rotate with the secondary vane reciprocating between open and closed positions with respect to the primary vane. Improvements to this type of fluid machine are defined to improve the rigidity of the internals while removing heat generated by compression as well as providing facile conversion of the machine from a liquid pump to a gas compressor, to provide for multiple flow streams at multiple flow rates in a single machine, multiple flow streams at multiple compression ratios in a single machine, and dual simultaneous function as a motor and a compressor.

16 Claims, 20 Drawing Sheets

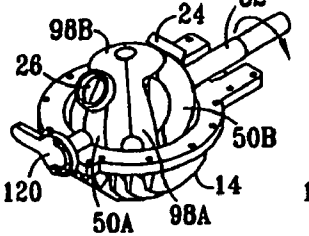
FIG 10A
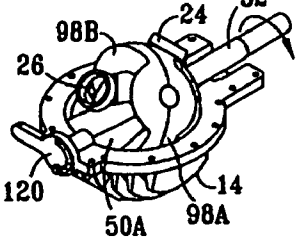
FIG 10B
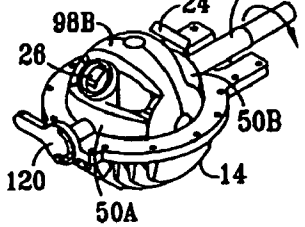
FIG 10C
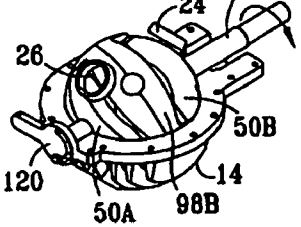
FIG 10D
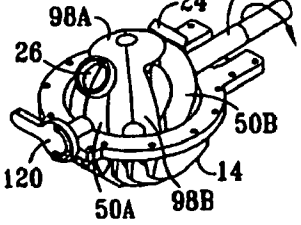
FIG 10E
FIG 12A
FIG 12B
FIG 12C
FIG 12D
FIG 12E
FIG 14A
FIG 14B
FIG 14C
FIG 14D
FIG 14E

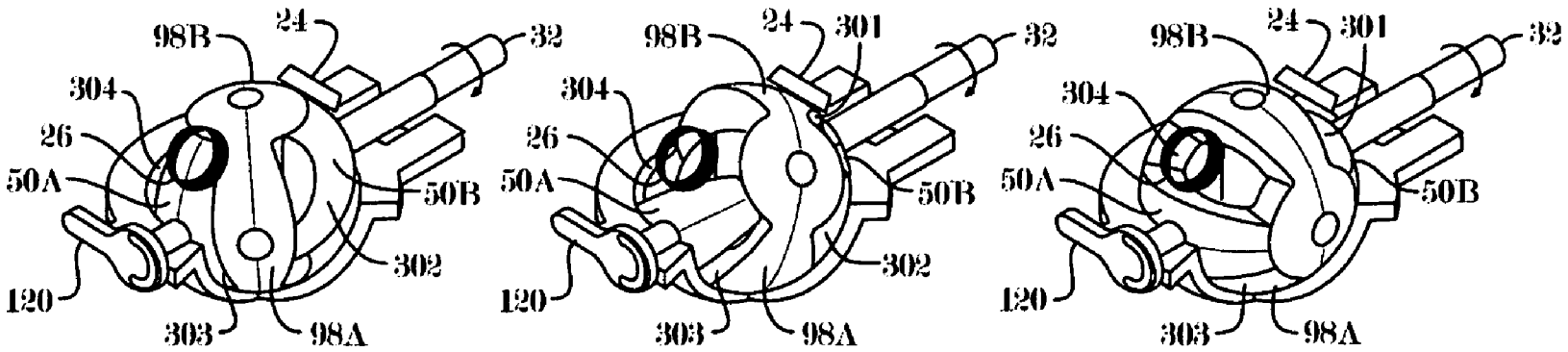
FIG 20A
FIG 20B
FIG 20C
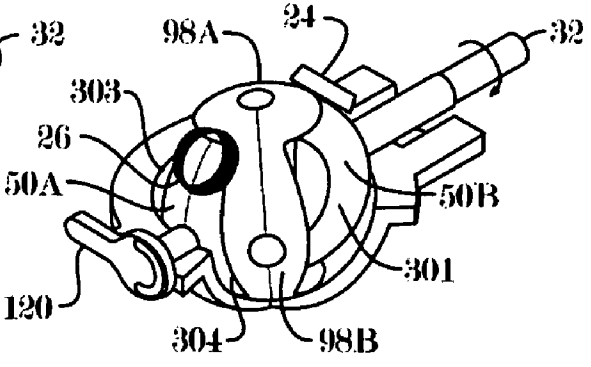
FIG 20D
FIG 20E
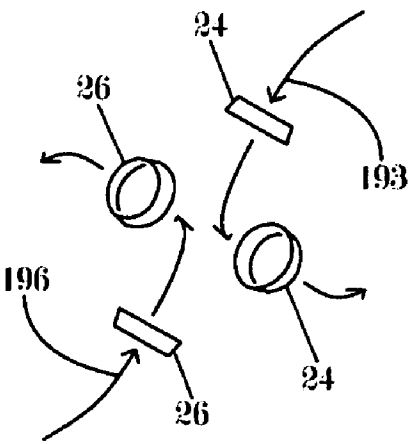
FIG 20F

SPHERICAL FLUID MACHINES

CROSS REFERENCE TO RELATED APPLICATIONS

This application is a divisional of and claims priority of U.S. application Ser. No. 10/784,709 filed Feb. 23, 2004 now abandoned.

TECHNICAL FIELD

The invention relates generally to fluid flow machines or devices such as motors, pumps or compressors and, more particularly, to the construction and control of such machines utilizing rotary mounted vanes.

BACKGROUND

Rotary motors, pumps and compressors have been known for many years. Generally these devices consist of a housing or casing within which one or more vanes rotate. This is in contrast to those devices that utilize a reciprocating, linearly moving piston. In the case of rotary pumps or compressors, the vanes are rotated by a shaft to pressurize or cause the fluid to flow through the device. In the case of a rotary motor, the opposite occurs. Fluid is introduced into the device under pressure to displace the vanes, which in turn rotate and power a drive shaft to which the vanes are coupled.

U.S. Pat. No. 5,199,864 to Stecklein discloses a rotary fluid pump that employs vanes rotating within a spherical housing and includes an interior carrier ring that guides a particular motion of the vanes so that they open and close to draw in and either pump or compress fluids. This patent also describes an embodiment (the "second embodiment") that uses an exterior carrier ring to guide the reciprocal motion of the vanes. These devices are highly efficient, and are capable of displacing large quantities of fluid. In this type of pump the flow of fluid is typically controlled by the rate at which the rotary vanes are rotated. By increasing the speed, more fluid is pumped through the device, while decreasing the speed decreases the amount of fluid pumped. Further, reversing the flow through the device, if possible at all, requires the vanes to be rotated in the opposite direction or requires that the inlet and outlet ports be reconfigured or reversed.

U.S. Pat. No. 6,241,493 to Turner discloses a particularly useful improvement on this type of spherical fluid machine that is configured to enable adjustments in both fluid capacity and fluid direction without changing the speed or direction of rotation of the vanes in the device by adjusting the orientation of an interior carrier ring. That patent is incorporated by reference into this application.

Fluid machines such as that described in U.S. Pat. Nos. 6,241,493 and 5,199,864 have great potential in a number of applications because of their great efficiency compared to many rotary vane pumps. Other advantages are that they are already ported, meaning that the manner in which the chambers communicate with the inlet and outlet ports negates the need for valves. These fluid machines can operate efficiently as liquid hydraulic pumps, gas compressors, vacuum pumps, or reversibly as motors when a pressurized fluid is available as a motive force.

When used in gas compressor applications a number of issues arise due to the nature of this type of fluid machine. It is well known that the compression of gases raises the gas temperature and therefore adds heat to the pump internals. This is particularly important in this type of spherical design in which the moving vanes are encircling a central sphere in which heat can build up. Therefore means are needed for removing heat from the central sphere in these applications.

The prior art fluid machines as described in U.S. Pat. No. 6,241,493 can be especially long running from a maintenance perspective because there is no direct physical contact between either the vanes and the central sphere around which they rotate nor physical contact between the vanes and the exterior housing of the machine. Low leakage between chambers is maintained by maintaining small clearances that minimize slippage or fluid loss across the clearances. This non-contact design though can lead to some vibration issues, particularly at high rotation speeds so a new design approach is needed to provide a more robust structure to the internal rotating vanes and spherical internal ball.

Also when this type of fluid machine is used in a compressor mode the port size is purposely made small to ensure good compression performance. When the same fluid machine is needed to pump relatively incompressible fluids a larger port size or different port shape is needed to ensure that there is communication between the outlet port and the compression chamber during the entire compression cycle to avoid fluid locking of the pump.

Also, previous versions of this type of fluid machine flowed only one fluid through its interior. Similarly, compressors of this type of fluid machine flowed provided only one compression ratio at any given time of operation. To flow a second fluid or provide a second compression ratio, a second fluid machine was required, which disadvantageously adds equipment and maintenance costs and requires additional equipment space.

Also, previous versions of this type of fluid machine flowed only a single stream of fluid or two streams of fluid with only equivalent flow rates, or were used only singly as either a pump or a motor at any given time. To flow a second stream at a different flow rate, or to simultaneously operate a pump and a motor, a second fluid machine was required, with the same disadvantages mentioned above.

Previous versions of this type of fluid machine also provided an inadequate balance of forces on one or more of the vanes, contributing to unnecessary wear on moving parts in the machine.

What is therefore needed is a design that addresses these limitations in the prior art fluid machines, removing the heat of compression when they are operated as a compressor, increasing the robustness of the rotating structure, providing for the flow of multiple fluids through a single machine, providing for dual use of a single machine as both a pump and a motor, providing for simultaneous multiple compression ratios, providing for balanced forces across vanes, providing adequate adjustability in port size and/or port shape to facilitate operation as both a pump and a compressor for both compressible and relatively incompressible fluids, and providing for the flow of multiple streams of fluid at different flow rates.

SUMMARY

These and other needs are addressed by the present invention, which simultaneously provides a method and apparatus for improving the rigidity of the internal spherical ball and removing internal heat from a spherical fluid machine operating as a compressor, a method and apparatus for simultaneously flowing multiple fluids through the same fluid machine, a method and apparatus for simultaneous use of the fluid machine as both a pump and a motor, a method for simultaneously providing multiple compression ratios in the same fluid machine, a method and apparatus for providing balanced forces across one or more vanes of the fluid machine, a method and apparatus for quickly converting operation back and forth from a compressor to a liquid hydraulic pump, and a method for simultaneously flowing multiple streams with different flow rates through a single machine. The solutions to these issues can apply to a number of these types of spherical pumps. For purposes of the description here the solutions will be described with respect to a fluid machine similar to the one described in U.S. Pat. No. 6,241,493. Accordingly that prior art fluid machine will be described first in some detail. It should be recognized however that the instant invention could be potentially applied in any spherical pump such as those described in U.S. Pat. No. 5,199,864 or in U.S. Pat. No. 5,147,193.

The fluid machine of this invention includes at least a housing having a wall defining a generally spherical interior, the housing having at least one port opening in communication with the interior of the housing; a first shaft mounted for rotation relative to the housing about a primary axis, wherein at least a portion of the first shaft extends through the housing wall; at least one primary vane disposed within the interior of the housing that rotates about the primary axis of the first shaft; at least one secondary vane disposed within the interior of the housing and mounted to the primary vane on a first pivotal axis, the secondary vane pivotally oscillating between alternating relatively open and closed positions with respect to the primary vane and defining at least a chamber within the housing interior having a volume which varies as the primary vane is rotated about the primary axis; wherein said at least one port opening is adjustable and has a first opening capable of accommodating continuous fluid communication with an approaching closing chamber for flowing incompressible fluids but can be adjusted to a second opening for flowing compressible fluids.

The fluid machine of this invention also includes at least a housing having a wall defining a generally spherical interior, the housing having at least one port opening in communication with the interior of the housing; a first shaft mounted for rotation relative to the housing about a primary axis, wherein at least a portion of the first shaft extends through the housing wall; at least one primary vane disposed within the interior of the housing that rotates about the primary axis of the first shaft; at least one secondary vane disposed within the interior of the housing and mounted to the primary vane on a first pivotal axis, the secondary vane pivotally oscillating between alternating relatively open and closed positions with respect to the primary vane and defining at least a chamber within the housing interior having a volume which varies as the primary vane is rotated about the primary axis; the secondary vane being pivotally coupled to a carrier ring, so that the secondary vane is pivotal about a second pivotal axis perpendicular to the axis of rotation of the carrier ring causing the secondary vane to reciprocate between relatively open and closed positions as the secondary vane is rotated about the primary axis by the first shaft; the axis of rotation of the carrier ring being oriented at an oblique angle in relation to the primary axis of the first shaft; and a second shaft that extends into the interior of the housing opposite the rotary shaft, the second shaft having a spherical portion about which the primary vane rotates and wherein the carrier ring is rotatably carried on the spherical portion of the second shaft; and wherein the first shaft is rotatably coupled to the spherical portion of the second shaft to provide rigidity to the structure.

The fluid machine of this invention also includes at least a housing having a wall defining a generally spherical interior, the housing having at least one port opening in communication with the interior of the housing; a first shaft mounted for rotation relative to the housing about a primary axis, wherein at least a portion of the first shaft extends through the housing wall; at least one primary vane disposed within the interior of the housing that rotates about the primary axis of the first shaft; at least one secondary vane disposed within the interior of the housing and mounted to the primary vane on a first pivotal axis, the secondary vane pivotally oscillating between alternating relatively open and closed positions with respect to the primary vane and defining at least a chamber within the housing interior having a volume which varies as the primary vane is rotated about the primary axis; the secondary vane being pivotally coupled to a carrier ring, so that the secondary vane is pivotal about a second pivotal axis perpendicular to the axis of rotation of the carrier ring causing the secondary vane to reciprocate between relatively open and closed positions as the secondary vane is rotated about the primary axis by the first shaft; the axis of rotation of the carrier ring being oriented at an oblique angle in relation to the primary axis of the first shaft; a second shaft that extends into the interior of the housing opposite the rotary shaft, the second shaft having a spherical portion about which the primary vane rotates and wherein the carrier ring is rotatably carried on the spherical portion of the second shaft; and wherein seals are installed on both primary and secondary vanes to contact the housing during operation and wherein seals are installed on both primary and secondary vanes to contact the spherical portion of the second shaft during operation.

The fluid machine of this invention also includes a housing having a wall defining a generally spherical interior, the housing having at least one port opening in communication with the interior of the housing; a first shaft mounted for rotation relative to the housing about a primary axis, wherein at least a portion of the first shaft extends through the housing wall; at least one primary vane disposed within the interior of the housing that rotates about the primary axis of the first shaft; at least one secondary vane disposed within the interior of the housing and mounted to the primary vane on a first pivotal axis, the secondary vane pivotally oscillating between alternating relatively open and closed positions with respect to the primary vane and defining at least a chamber within the housing interior having a volume which varies as the primary vane is rotated about the primary axis; wherein the relative fluid pressure force on the primary and secondary vanes are balanced in order to lower the wear on interfacing surfaces and bearings.

The fluid machine of this invention also includes a housing having a wall defining a generally spherical interior, the housing having at least one port opening in communication with the interior of the housing; a first shaft mounted for rotation relative to the housing about a primary axis, wherein at least a portion of the first shaft extends through the housing wall; at least one primary vane disposed within the interior of the housing that rotates about the primary axis of the first shaft; at least one secondary vane disposed within the interior of the housing and mounted to the primary vane on a first pivotal axis, the secondary vane pivotally oscillating between alternating relatively open and closed positions with respect to the primary vane and defining at least a chamber within the housing interior having a volume which varies as the primary vane is rotated about the primary axis; wherein a first fluid and a second fluid flow through the fluid machine.

The instant invention also includes a method for adjusting the use of a fluid machine including at least the steps of providing a housing having a wall defining a generally spherical interior, the housing having at least one port opening in communication with the interior of the housing through which fluid from a fluid source is allowed to flow; providing a first shaft mounted for rotation relative to the housing about a primary axis, wherein at least a portion of the first shaft extends through the housing wall; providing at least one primary vane disposed within the interior of the housing that rotates about the primary axis; providing at least one secondary vane disposed within the interior of the housing and mounted to the primary vane on a first pivotal axis; rotating the primary vane about the primary axis with the secondary vane pivotally oscillating between alternating relatively open and closed positions with respect to the primary vane, the housing, the primary vane, and the secondary vane defining a fluid chamber for containing fluid within the housing interior having a volume that varies as the primary vane is rotated about the primary axis; wherein the at least one port opening is adjustable and has a first opening capable of accommodating continuous fluid communication with an approaching closing chamber for pumping incompressible fluids but can be adjusted to a second opening to convert the fluid machine to a compressor for compressible fluids.

The instant invention also includes a method of improving the structural rigidity of a fluid machine including at least the steps of: providing a housing having a wall defining a generally spherical interior, the housing having at least one port opening in communication with the interior of the housing; providing a first shaft mounted for rotation relative to the housing about a primary axis, wherein at least a portion of the first shaft extends through the housing wall; providing at least one primary vane disposed within the interior of the housing that rotates about the primary axis of the first shaft; providing at least one secondary vane disposed within the interior of the housing and mounted to the primary vane on a first pivotal axis, the secondary vane pivotally oscillating between alternating relatively open and closed positions with respect to the primary vane and defining at least a chamber within the housing interior having a volume which varies as the primary vane is rotated about the primary axis; the secondary vane being pivotally coupled to a carrier ring, so that the secondary vane is pivotal about a second pivotal axis perpendicular to the axis of rotation of the carrier ring causing the secondary vane to reciprocate between relatively open and closed positions as the secondary vane is rotated about the primary axis by the first shaft; the axis of rotation of the carrier ring being oriented at an oblique angle in relation to the primary axis of the first shaft; providing a second shaft that extends into the interior of the housing opposite the rotary shaft, the second shaft having a spherical portion about which the primary vane rotates and wherein the carrier ring is rotatably carried on the spherical portion of the second shaft; and rotatably coupling the first shaft to the spherical portion of the second shaft to provide rigidity to the structure.

The instant invention also includes a method for improving heat conduction and limiting fluid leakage in a fluid machine comprising the steps of: providing a housing having a wall defining a generally spherical interior, the housing having at least one port opening in communication with the interior of the housing; providing a first shaft mounted for rotation relative to the housing about a primary axis, wherein at least a portion of the first shaft extends through the housing wall; providing at least one primary vane disposed within the interior of the housing that rotates about the primary axis of the first shaft; providing at least one secondary vane disposed within the interior of the housing and mounted to the primary vane on a first pivotal axis, the secondary vane pivotally oscillating between alternating relatively open and closed positions with respect to the primary vane and defining at least a chamber within the housing interior having a volume which varies as the primary vane is rotated about the primary axis; the secondary vane being pivotally coupled to a carrier ring, so that the secondary vane is pivotal about a second pivotal axis perpendicular to the axis of rotation of the carrier ring causing the secondary vane to reciprocate between relatively open and closed positions as the secondary vane is rotated about the primary axis by the first shaft; the axis of rotation of the carrier ring being oriented at an oblique angle in relation to the primary axis of the first shaft; providing a second shaft that extends into the interior of the housing opposite the rotary shaft, the second shaft having a spherical portion about which the primary vane rotates and wherein the carrier ring is rotatably carried on the spherical portion of the second shaft; and providing seals on both primary and secondary vanes that contact both the housing and the spherical portion of the second shaft during operation.

The instant invention also includes a method for balancing the momentum and the relative fluid pressure on the secondary vanes of a fluid machine including at least the steps of: providing a housing having a wall defines a generally spherical interior, the housing having at least one port opening in communication with the interior of the housing through which fluid from a fluid source is allowed to flow; providing a first shaft mounted for rotation relative to the housing about a primary axis, wherein at least a portion of the first shaft extends through the housing wall providing at least one primary vane disposed within the interior of the housing that rotates about the primary axis; providing at least one secondary vane disposed within the interior of the housing and mounted to the primary vane on a first pivotal axis; rotating the primary vane about the primary axis with the secondary vane pivotally oscillating between alternating relatively open and closed positions with respect to the primary vane, the housing, the primary vane, and the secondary vane defining a fluid chamber for containing fluid within the housing interior having a volume that varies as the primary vane is rotated about the primary axis; adjusting the density and thereby the weight of the secondary vane in order to balance momentum of the vane with the relative fluid pressure on that vane.

The instant invention also includes a method for simultaneously flowing a first fluid and a second fluid through the same fluid machine including at least the steps of: providing a housing having a wall defining a generally spherical interior, the housing having at least one port opening in communication with the interior of the housing through which fluid from a fluid source is allowed to flow; providing a first shaft mounted for rotation relative to the housing about a primary axis, wherein at least a portion of the first shaft extends through the housing wall; providing at least one primary vane disposed within the interior of the housing that rotates about the primary axis; providing at least one secondary vane disposed within the interior of the housing and mounted to the primary vane on a first pivotal axis; rotating the primary vane about the primary axis with the secondary vane pivotally oscillating between alternating relatively open and closed positions with respect to the primary vane, the housing, the primary vane, and the secondary vane defining a fluid chamber for containing fluid within the housing interior having a volume that varies as the primary vane is rotated about the primary axis; and providing a first fluid and a second fluid and connecting the first and second fluids to appropriate port openings to enable separate movement of the first and second fluids through the fluid machine.

BRIEF DESCRIPTION OF THE DRAWINGS

For a more complete understanding of the present invention, and the advantages thereof, reference is now made to the following descriptions taken in conjunction with the accompanying drawings, in which:

FIGS. 10A-10E are sequenced perspective views of the pump of FIGS. 9A-9D with the control lever in the 0 degree position, as the rotary shaft of the pump is rotated 180 degree during the pump's operation;

FIGS. 12A-12E are sequenced perspective views of the pump of FIGS. 11A-11D, with the control lever in the 180 degree position, as the rotary shaft of the pump is rotated 180 degrees during the pump's operation;

FIGS. 14A-14E are sequenced perspective views of the pump of FIGS. 13A-13D, with the control lever in the 90 degree or neutral position, as the rotary shaft of the pump is rotated 180 degrees during the pump's operation;

FIGS. 20A-20E are sequenced perspective views of the pump of FIGS. 9A-9D with the control lever in the 0 degree position, as the rotary shaft of the pump is rotated 180 degree during the pump's operation, showing the simultaneous flow of two fluids through the pump.

FIG. 20F is a view of the port openings only of FIGS. 20A-20E to show the flow of two different fluids.

DETAILED DESCRIPTION

Figure 1:
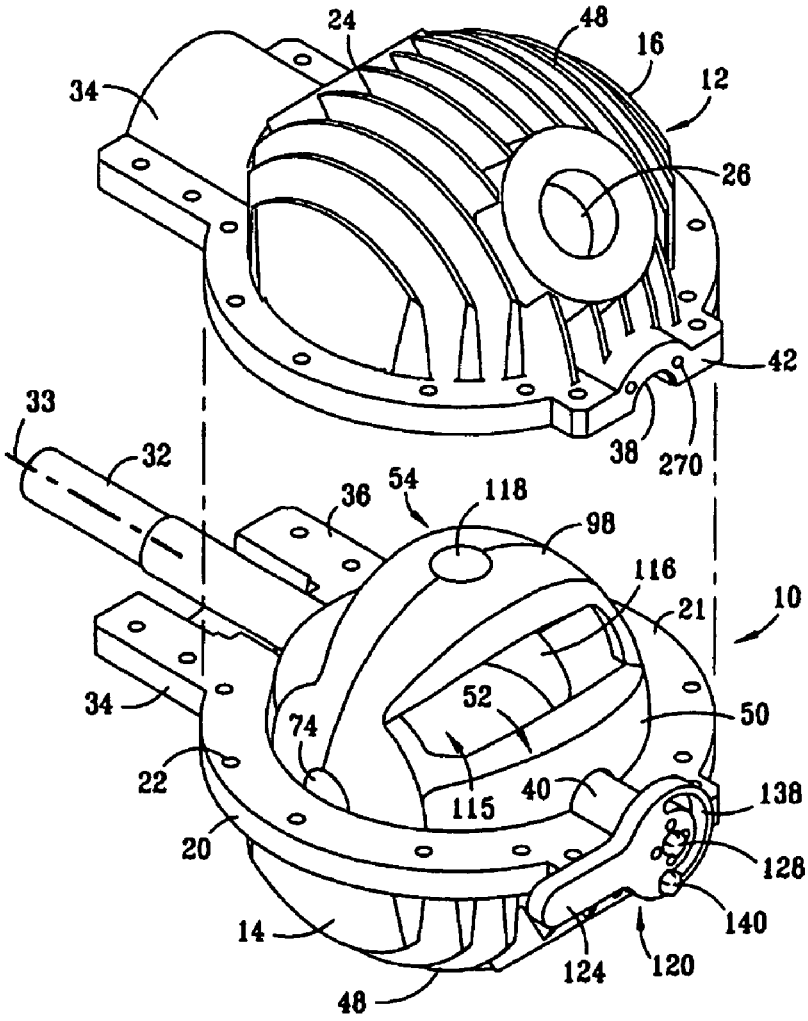
FIG. 1 is a front perspective view of a fluid pump, shown with the upper half of a housing of the pump exploded away to reveal internal components of the device.

Referring to FIG. 1 of the drawings, the reference numeral 10 generally designates a fluid pump or compressor of the type that can apply the improvements of the instant invention. The pump 10 is generally similar in construction to the device described in U.S. Pat. No. 6,241,493. It should be noted that although the device 10 has been more specifically described with respect to its function and use as a fluid pump or compressor, it could also function as motor, as would be readily appreciated by those skilled in the art.

Figure 2:
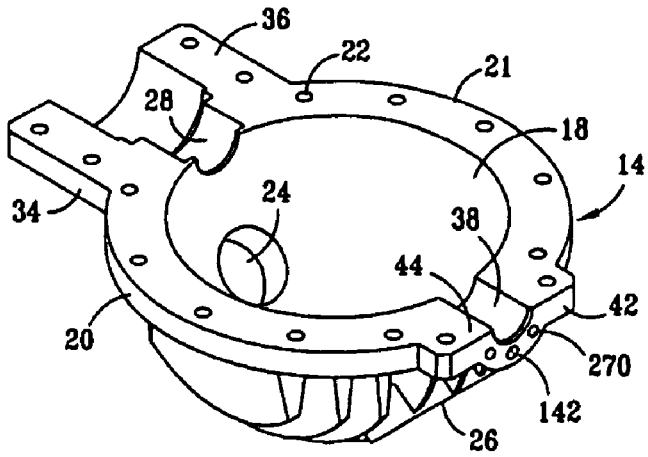
FIG. 2 is a perspective view of the lower half of the housing of the pump of FIG. 1 with the internal components removed.

The pump 10 includes a housing 12, which is formed into two halves 14, 16. Each half 14, 16 of the housing 12 is generally configured the same as the other and has a hemispherical interior cavity 18 (FIG. 2), which forms a spherical interior of the housing 12 when the two halves 14, 16 are joined together. Each housing half or piece 14, 16 is provided with a circular flange 20 having a flat facing surface 21 which extends around the perimeter of the cavity 18 and which abuts against and engages the corresponding flange 20 of the other housing piece 14, 16. The flange face 21 lies in a plane that generally divides the spherical housing interior 18 into two equal hemispherical halves when the housing halves 14, 16 are joined together.

A fluid tight seal is formed between the housing halves 14, 16 when the halves 14, 16 are joined together. Formed in each housing piece 14, 16 are rear and front fluid ports 24, 26 that communicate between the exterior of the housing and the housing interior 18. The fluid ports 24, 26 are circumferentially spaced apart approximately 90 degrees from the next adjacent port, with the approximate center of each fluid port being contained in a plane oriented perpendicular to the flange faces 21 and that bisects the interior of the housing 12 when the housing halves 14, 16 are joined together. The ports 24, 26 are positioned about 45 degrees from the flange faces 21 on each housing half 14, 16.

Formed at the rearward end of each housing half 14, 16 adjacent to the rearward port 24 is a recessed area 28 formed in the circular flange 20 for receiving a main input shaft 32 (FIG. 1), which extends for a distance into the housing interior 18. The primary axis or axis of rotation 33 of the input shaft 32 lies generally in the same plane as the flange faces 21. An input shaft collar 34 extends outwardly from the housing halves 14, 16 and is provided with a similarly flanged surface 36 for facilitating joining the housing halves together.

Located at the forward end of the housing 12 opposite the collar 34 in each housing half 14, 16 is a recessed area 38 formed in the circular flange 20 to form a shaftway for receiving a second shaft 40 (FIG. 1). A neckpiece 42 extends outwardly from the circular flange 20 and is also provided with a flanged surface 44 to facilitate joining of the housing halves together.

In the particular embodiment shown, the exterior of the housing 12 is provided with a plurality of parallel spaced apart fins or ribs 48 which provide structural rigidity to the housing while reducing the weight of the device. The fins or ribs 48 also provide an increased surface area of the housing to facilitate heat transfer.

Figure 3:
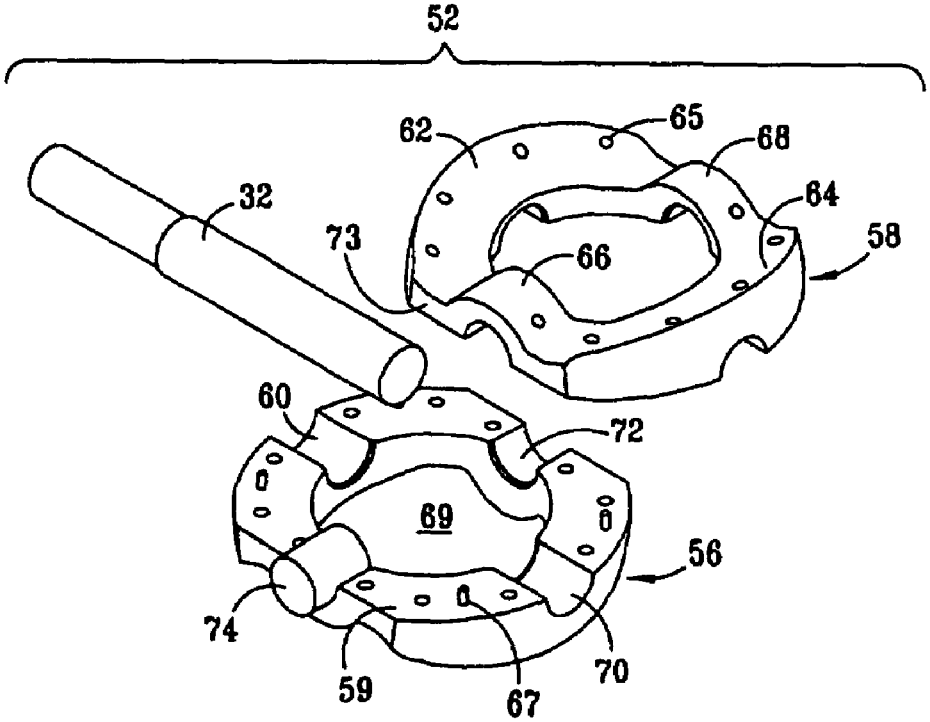
FIG. 3 is a perspective view of a rotary shaft and primary vane assembly of the pump of FIG. 1, shown with the primary vane assembly exploded into two halves.

The housing 12 houses primary and secondary vane assemblies 52, 54, respectively. Referring to FIG. 3, the primary vane assembly, designated generally at 52, is formed into two halves 56, 58. The primary vane halves 56, 58 are generally configured the same, each having a generally flat inner surface 59 that abuts against the inner surface of the other half. The primary vane halves 56, 58 each have opposite vane members 62, 64, that are joined together at opposite ends by integral hinge portions 66, 68 to define a central circular opening 69. When the primary vane halves 56, 58 are joined together, the vane members 62 and 64 form a single opposing vane.

The vane members 62 are each provided with an input shaft recess 60 formed in the flat surface 59 for receiving and coupling to the input shaft 32 when the vane halves 56, 58 are joined together. The primary vane assembly 52 is rigidly coupled to the input shaft 32 so that rotation of the input shaft 32 is imparted to the primary vane assembly 52 to rotate the combined vanes 56,58 within the housing interior 18.

Similarly, the vane members 64 are provided with a second shaft recess 70 formed in the flat surface 59 for receiving the second shaft 40. The second shaft recess 70 is configured to allow the primary vane assembly 52 to freely rotate about the second shaft 40. The outer ends of the vane members 62, 64 have a generally convex spherical lune surface configuration corresponding to the spherical interior 18 of the housing 12.

The hinge portions 66, 68 are each provided with a stub shaft recess 72. A stub shaft 74 is shown provided with the hinge portion 66 of the vane half 56. This stub shaft 74 may be integrally formed with one of the vane halves 56, 58 or may be a separate member that is fixed in place. As is shown, the stub shaft 74 projects a distance outward beyond the hinge portion 66. The hinge portions 66, 68 are each squared or flat along the outer side edges 73.

Figure 4:
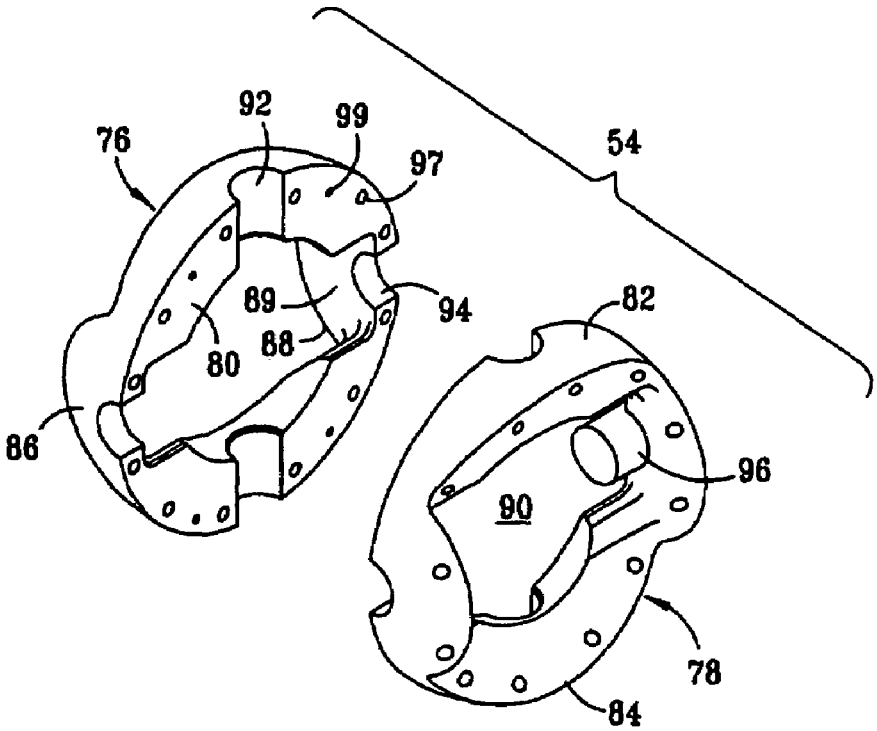
FIG. 4 is a perspective view of a secondary vane assembly of the pump of FIG. 1, shown with the secondary vane assembly exploded into two halves.

Referring to FIG. 4, the secondary vane assembly 54 is also shown being formed in two halves 76, 78, each half 76, 78 being generally similar in construction. The secondary vane halves 76, 78 are generally configured the same, each having an inner surface 80, which is generally flat and which abuts against the inner surface of the other vane half. The secondary vane halves 76, 78 each have opposite vane members 82, 84, that are joined together at opposite ends by integral hinge portions 86, 88 to define a central circular opening 90. When the secondary vane halves 76, 78 are joined together; the vane members 82 and 84 form a single opposing vane.

The vane members 82, 84 are each provided with pivot post recesses 92 formed in the inner surfaces 80 of each vane half 76,78. The outermost ends of the vane members 82, 84 also have a generally convex spherical lune surface configuration corresponding to the spherical interior 18 of the housing 12.

The hinge portions 86, 88 are each provided with a stub shaft recess 94. A second stub shaft 96 is shown provided with the hinge portion 88 of the vane half 78. This stub shaft 96 may be integrally formed with one of the vane halves 76, 78 or may be a separate member that is fixed in place. As is shown, the stub shaft 96 projects a distance inward from the hinge portion 88. Both the hinge portions 86, 88 are squared or flat along the inner side edges 89 to correspond to the flat outer side edges 73 of the hinge portions 66, 68 of the primary vane halves 56, 58. The shape of narrow ridges 83 generally complement the shape of the exterior surfaces of hinge portions 66, 68. The exterior of the hinge portions 86, 88 are in the form of a convex spherical segment or sector that is contoured smoothly with the curved surface of the outer ends of the vane members 82, 84, and corresponds in shape to the spherical interior 18 of the housing 12.

When the primary and secondary vanes 52, 54 are coupled together (FIG. 1) and mounted to the main input shaft 32, the stub shafts 74, 96 are generally concentric. The stub shaft 74 of the primary vane assembly 52 is received within the recesses 94 of the hinge portion 86 of the secondary vane assembly 54 to allow relative rotation of the secondary vane assembly 54 about the stub shaft 74. Likewise, the stub shaft 96 of the secondary vane assembly 54 is received within the recesses 72 of the hinge portion 68 of the primary vane assembly 52 and allows relative rotation of the primary vane assembly 52 about the stub shaft 96. In this way, the primary and secondary vanes assemblies 52, 54 remain interlocked together while the secondary vane assembly 54 is allowed to pivot relative to the primary vane assembly 52 about a first pivotal axis that is perpendicular to the primary axis 33 of the input shaft 32.

Figure 5:
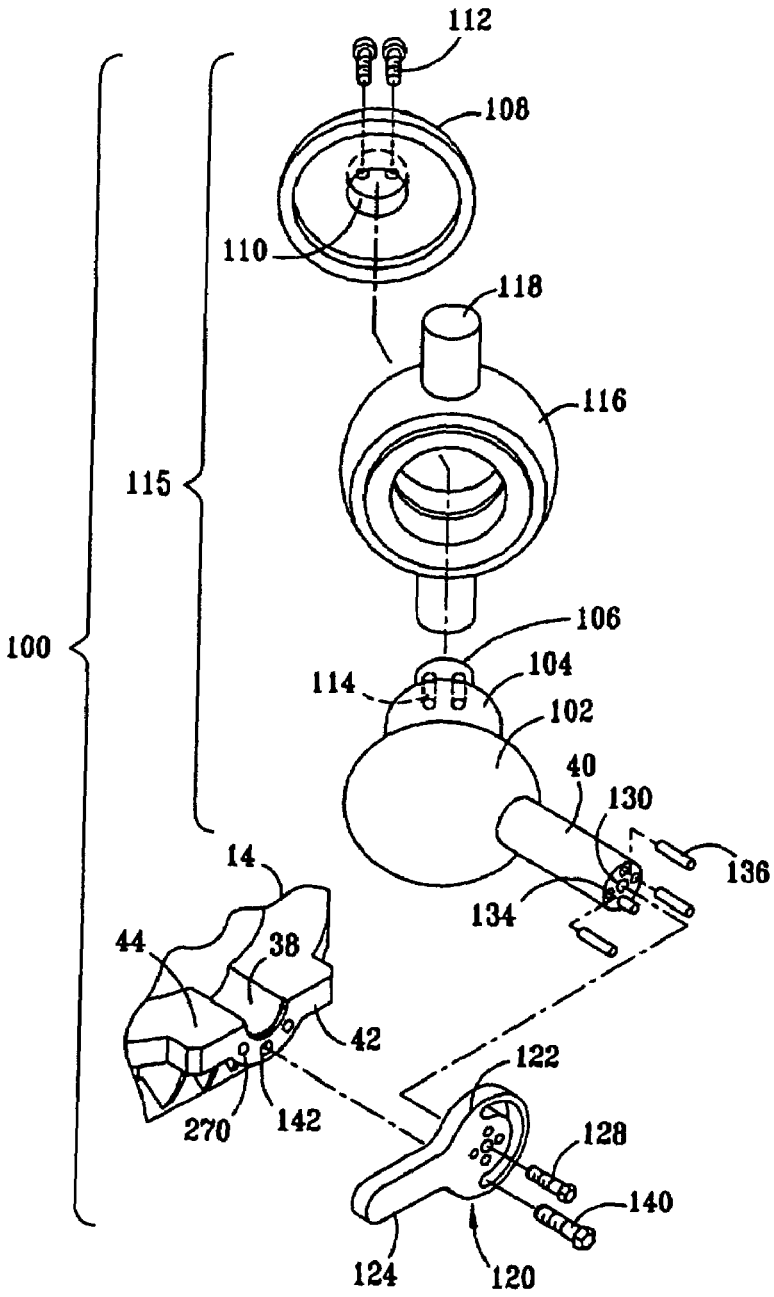
FIG. 5 is an exploded perspective view of a fixed second shaft assembly of the pump of FIG. 1, constructed in accordance with the invention.

FIG. 5 shows an exploded view of a fixed second shaft or race assembly 100. The second shaft assembly 100 is comprised of the cylindrical second shaft 40, which is received in the recesses 38 of the housing halves 14, 16, as discussed previously. The cylindrical second shaft 40 is coaxial with the primary axis 33 of the input shaft 32 when mounted to the housing 12. At the inner end of the shaft 40 is a spherical shaft portion 102 in the form of a sphere section. Projecting from the inner side of the spherical shaft portion 102 is a cylindrical carrier ring shaft 104. The longitudinal axis of the carrier ring shaft 104 is oriented at an oblique angle with respect to the axis of shaft 40. This angle may vary, but is preferably between about 30 degrees to 60 degrees, with 45 degrees being the preferred angle. A boss 106 projects from the end of the shaft 104 to facilitate mounting of an end cap 108, which is in the form of a spherical section. The end cap 108 is provided with a recess 110 for receiving the boss 106 of shaft 104. In the embodiment shown, a pair of threaded fasteners 112, such as screws or bolts, which are received within eccentrically disposed threaded bolt holes 114 formed in the boss 106, are used to secure and fix the end cap 108 to the shaft 104. Two or more fasteners may be used. Because the fasteners are eccentrically located with respect to the axis of the shaft 40, they prevent relative rotation of the end cap 108 with respect to the shaft 40.

The end cap 108 is used to secure a central carrier ring 116, which is rotatably mounted on the carrier ring shaft 104. The carrier ring 116 is configured with an outer surface in the form of a spherical segment so that when the carrier ring 116 is mounted on the shaft 104 and the end cap 108 is secured in place, the combination of the spherical portion 102, carrier ring 116 and end cap 108 generally form a complete sphere that is joined to the end of the shaft 40. This complete sphere is designated generally as central ball 115. The diameter of this sphere generally corresponds to the diameter of the central openings 69, 90 of the primary and secondary vane assemblies 52, 54, respectively, to allow the vane assemblies 52, 54 to rotate about this spherical portion of the second shaft assembly 100, while being in close engagement thereto. The carrier ring 116 is approximately centered between the spherical portion 102 and the end cap 108.

The carrier ring 116 is provided with oppositely projecting pivot posts 118 that project radially outward from the outer surface of the carrier ring 116. The posts 118 are concentrically oriented along an axis that is perpendicular to the axis of rotation of the carrier ring 116. The posts 118 are received within the pivot post recesses 92 of the secondary vane halves 76, 78 when the vane assembly 50 is mounted over the spherical portion of the second shaft assembly 100 formed by the spherical portion 102, carrier ring 116 and end cap 108.

Figure 6:
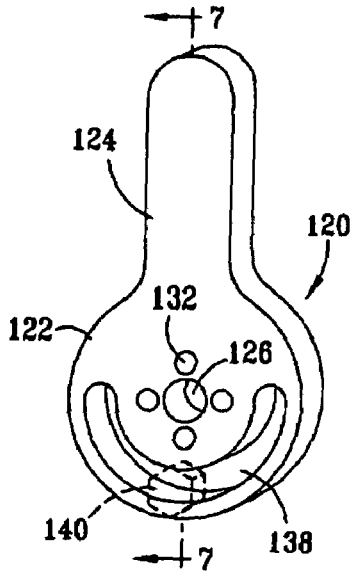
FIG. 6 is a perspective view of a flow capacity control lever for rotating the second shaft of FIG. 5.
Figure 7:
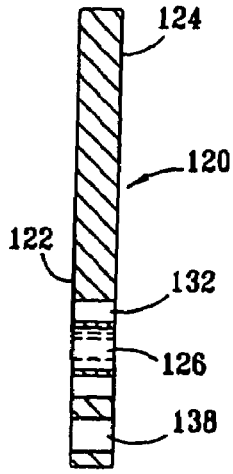
FIG. 7 is a cross-sectional view of the lever of FIG. 6 taken along the lines 7-7.

Coupled to the second shaft 40 opposite the spherical portion 102 is a flow capacity control lever 120 for manually rotating the shaft 40 and spherical portion 102. The control lever 120, shown in more detail in FIGS. 6 and 7, has a generally circular-shaped body portion 122. A lever arm 124 extends from the body portion 122. Formed generally in the center of the body portion 122 is a bolt hole 126 for receiving a bolt 128 for fastening the lever 120 to the shaft 40 by means of a central, threaded bolt hole 130 formed in the outer end of the shaft 40. Spaced around bolt hole 126 are dowel holes 132 which correspond to dowel holes 134 formed in the shaft. Dowels 136 are received within the dowel holes 132, 134 to prevent relative rotation of the control lever 120 with respect to the shaft 40. Although one particular method of coupling the lever 120 to the shaft 40 is shown, it should be apparent to those skilled in the art that other means may be used as well. The control lever acts as a vane guide member to oscillate the secondary vane to various opening positions relative to the primary vane.

An arcuate slot 138 that extends in an arc of about 180 degrees is formed in the body portion 122 of the lever 120 for receiving a setscrew or bolt 140. The arcuate slot 138 overlays a threaded bolt hole 142 formed in the housing neck piece 42 of the housing half 14, when the shaft assembly 100 is mounted to the housing 12. The setscrew 140 is used to fix the position of the lever 120 to prevent rotation of the shaft 40 once it is in the desired position. By loosening the setscrew 140, the lever 120 can be rotated to various positions to rotate the shaft assembly 100, with the setscrew 140 sliding within the slot 138.

Figure 8A:
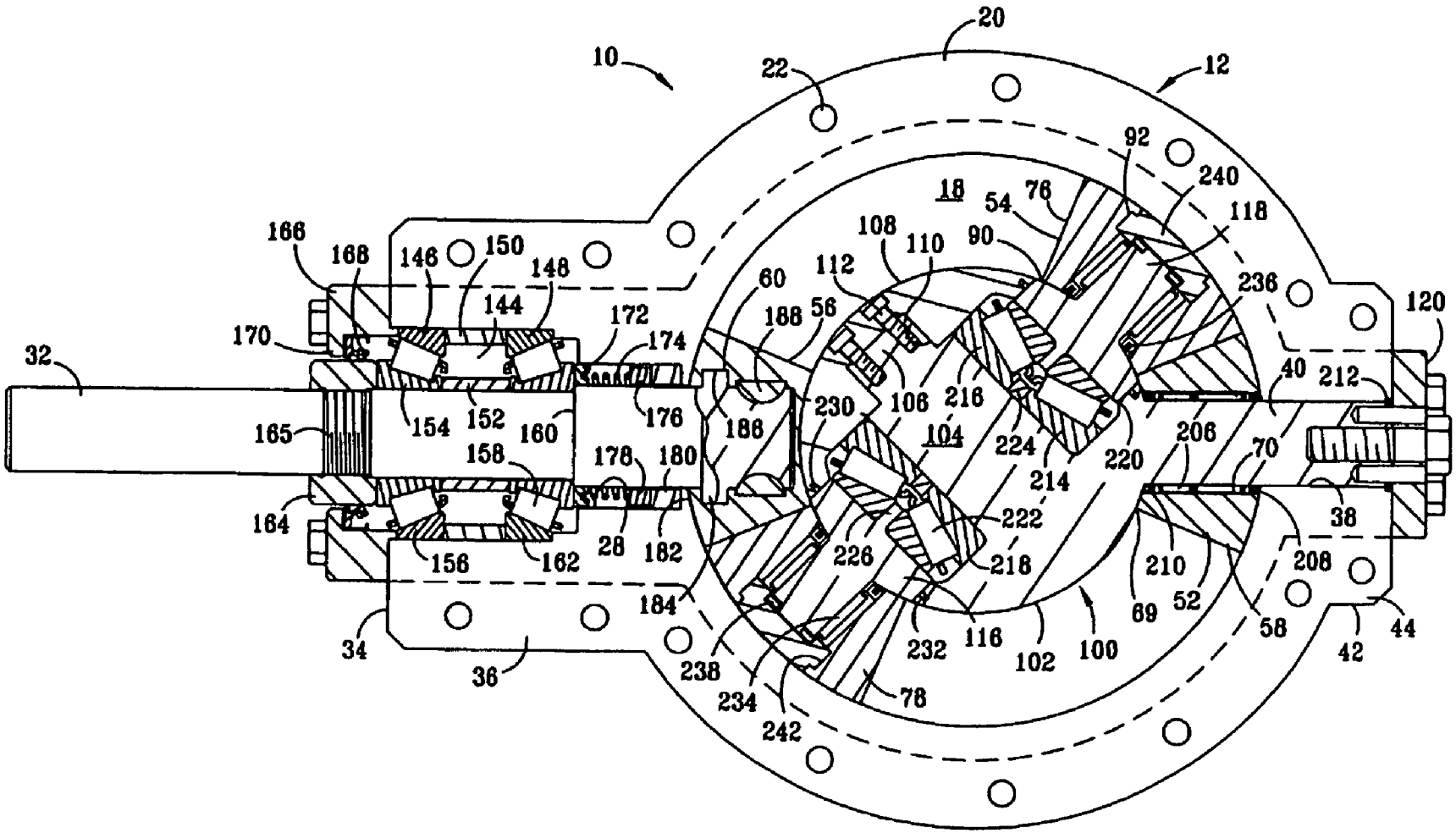
FIG. 8A is a detailed cross-sectional view of the pump of FIG. 1.

FIG. 8A is a longitudinal cross-sectional view of the assembled pump 10 shown in more mechanical detail. Although one particular embodiment is shown, it should be apparent to those skilled in that a variety of different configurations and components, such as bearings, seals, fasteners, etc., could be used to ensure the proper operation of the pump 10. The embodiment described is for ease of understanding the invention and should in no way be construed to limit the invention to the particular embodiment shown.

As can be seen, the input shaft 32 extends through the collar 34 at the rearward end of the housing 12. The collar 34 defines a cavity 144 that houses a pair of longitudinally spaced input shaft roller bearing assemblies 146, 148. Each of the roller bearing assemblies 146, 148 is comprised of an inner race 154 and an outer race 156, which houses a plurality of circumferentially spaced tapered roller bearings 158 positioned therebetween. Spacers 150, 152 maintain the roller bearing assemblies 146, 148 in longitudinally spaced apart relationship along the input shaft 32, with the inner race 154 of the roller bearing assembly 148 abutting against an outwardly projecting annular step 160 of the drive shaft 32, and the outer race 156 abutting against a inwardly projecting annular shoulder 162 of the collar 34.

A bearing nut 164 threaded onto a threaded portion 165 of the input shaft 32 abuts against the inner race 154 of bearing assembly 146 and preloads the inner races 154. Bolted to the end of the collar 34 is a bearing retainer ring 166. The bearing retainer ring 166 abuts against the outer race 156 of bearing assembly 146 and preloads the outer bearing races 156. The retainer ring 166 also serves to close off the cavity 144 of the housing collar 34. An annular oil seal 168 seated on the annular lip 170 of the retainer ring 166 bears against the exterior of the bearing nut 164 to prevent leakage of oil or lubricant from the bearing cavity 144.

Located within the recessed area 28 and surrounding the input shaft 32 is a washer 172 that abuts against the inner race 154 of the bearing assembly 148. A compressed coiled spring 174 abuts against the washer 172 and bears against a carbon sleeve 176. The sleeve 176 is provided with an O-ring seal 178 located within an inner annular groove of the sleeve 176. The sleeve 176 abuts against a fixed annular ceramic plate 180, which seats against an annular lip 182 projecting into the recessed area 28. The low coefficient of friction between the interfacing carbon sleeve 176 and ceramic plate 180 allows the sleeve 176 to rotate with the input shaft 32, while providing a fluid-tight seal to prevent fluid flow between the pump interior 18 and the collar cavity 144.

The input shaft 32 extends into the interior 18 of the housing 12 a short distance and is coupled to the primary vane assembly 52 within the recesses 60 formed in vane halves 56, 58. The end of the shaft 32 is provided with a annular collar 184 received in grooves 186 formed in the recesses 60 of the vane halves 56, 58 to prevent relative axial movement of the shaft 32 and vane assembly 52. Relative rotational movement between the vane assembly 52 and shaft 32 is prevented by key members 188 received in key slots of the vane assembly 52 and shaft 32, respectively.

Surrounding the second shaft portion 40 within the recess 70 of the primary vane assembly 52 are longitudinal roller bearings 206. Seals 208, 210 are provided at either end of the roller bearing assembly 206 to prevent fluid from escaping along the second shaft 40 through recesses 70. A static O-ring seal 212 surrounds the shaft 40 at the interface of the lever arm 120 with housing neckpiece 42 to prevent fluid loss through shaftway 38.

Surrounding the carrier ring shaft 104 are roller bearing assemblies 214, 216. Each roller bearing assembly 214, 216 is comprised of an inner race 218 and an outer race 220 with a plurality of tapered roller bearings 222 therebetween. The inner races 218 of assemblies 214, 216 are spaced apart by means of a spacer 224. The inner face of the carrier ring 116 rests against the outer races 220. An annular web 226 projects radially inward from the inner annular face of the carrier ring 116 and serves as a spacer between the outer races 220 and prevents axial movement of the carrier ring 116 along the shaft 104. For spherical pump configurations that have the equivalent to carrier ring 116 on the outside of housing 12, the equivalent ring is preferably manufactured in two or more sections to allow ease of assembly of the fluid machine. These sections may be, for example, two semicircular segments that divide the equivalent ring approximately across the diameter, or two circular segments that join at the center circumferential plane of the equivalent ring. Said sections are then joined with fasteners.

Lip seals 230, 232 provided in inner faces of the end cap 108 and spherical portion 102, respectively, engage the side edges of the carrier ring 116 to prevent fluid from entering the annular space surrounding the carrier ring shaft 104 where the bearing assemblies 214, 216 are housed and which contains a suitable lubricant for lubricating the bearing assemblies 214, 216. At lower rates of rotation a lubricant or coolant may not be needed on a continual basis.

Axially oriented roller bearings 234 surround the pivot posts 118 to allow the secondary vanes 54 to rotate. Fluid seals 236 are provided at the base of posts 118. Radially oriented thrust bearings 238 located at the terminal ends of posts 118 and are held in place by thrust caps 240. The thrust caps 240 are held in place within annular grooves 242 formed in the pivot post recesses 92.

As can be seen, the outer ends of the primary vanes 52 and secondary vanes 54 are in close proximity or a near touching relationship to provide a clearance with the interior 18 of the housing 12. There is also a slight clearance between the spherical end portion of the fixed second shaft assembly 100 and the central openings 69, 90 of the primary and secondary vanes 52, 54. These clearances should be as small as possible to allow free movement of the vanes 52, 54 within the interior 18, while minimizing slippage or fluid loss across the clearances, and to allow for differences in thermal expansion between the housing 12, the vanes 52, 54 and the spherical portion 102 and end cap 108.

Figure 8B:
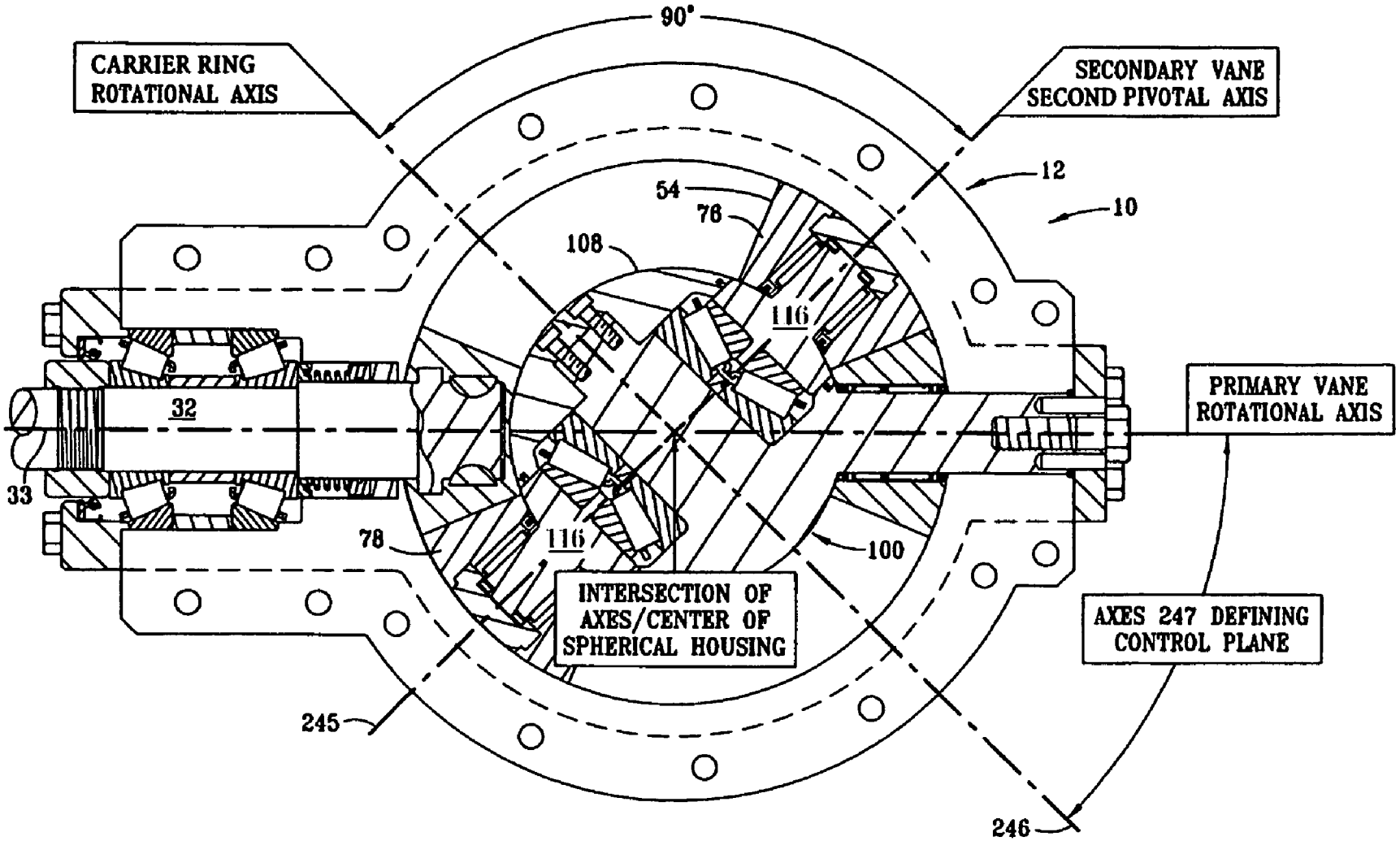
FIG. 8B is a cross-sectional view of the pump of FIG. 1, showing various rotational axes of the device.

FIG. 8B illustrates the relationship of the various rotational axes of the pump components. As shown, carrier ring 116 rotates about the carrier ring axis 246. The axis 246 intersects the primary vane axis 33 at an oblique angle and defines a control plane 247. The secondary vane 54 pivots about the pivot posts 118 about a secondary vane second pivotal axis 245 that remains perpendicular to the carrier ring axis 246. This second pivotal motion of the secondary vane is simultaneous with the pivotal motion of the secondary vane about the first pivotal axis perpendicular to the primary axis, which was discussed earlier.

Figure 8C:
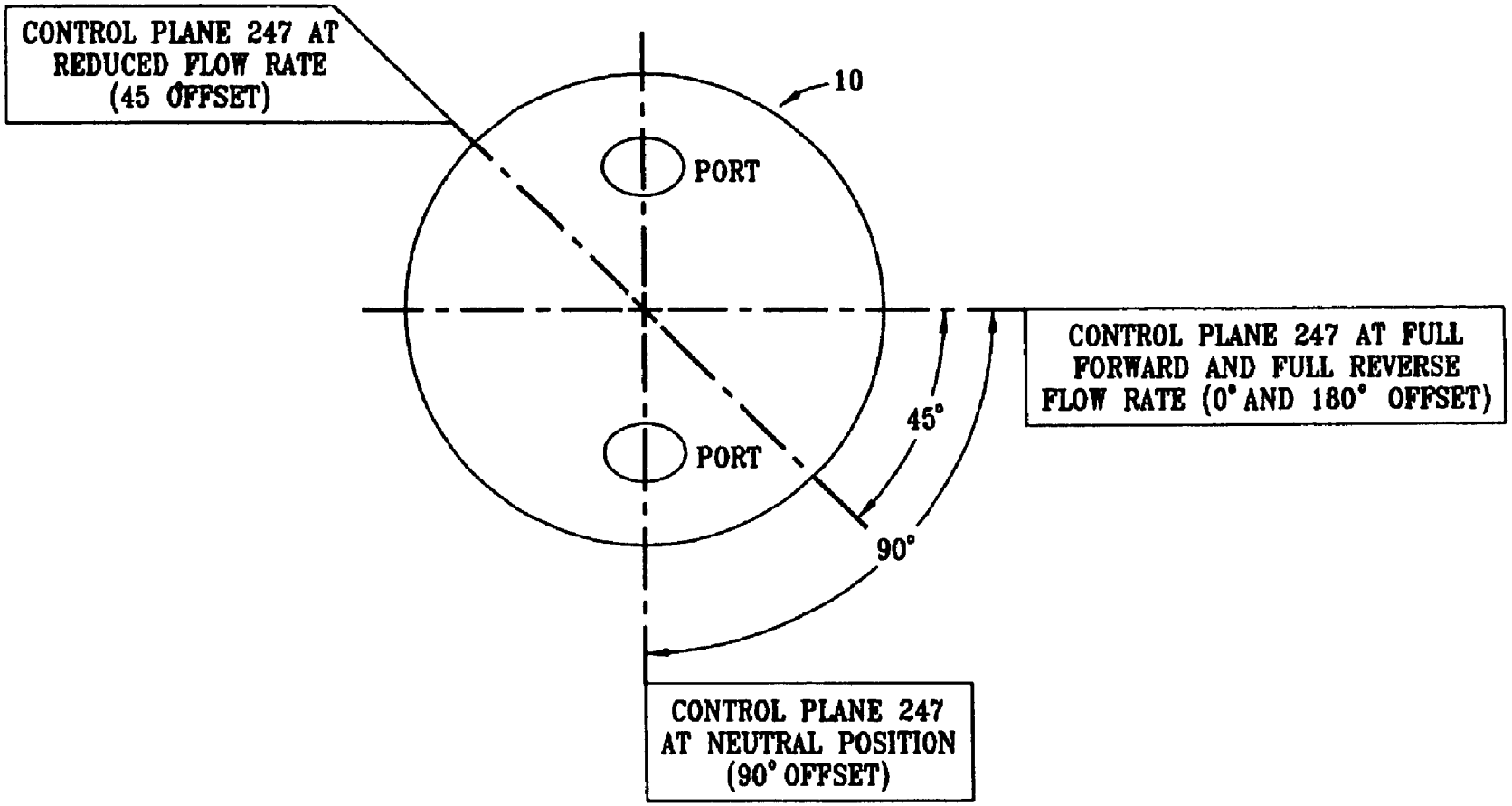
FIG. 8C is a schematical diagram of the pump housing showing the rotation of a control plane with respect to the pump housing.

FIG. 8C shows an end view of the pump 10 as viewed along the primary axis, and showing the various orientations of the timing or control plane 247 that may be achieved by rotating the second shaft assembly 100, as is described below.

Referring to FIGS. 9-14, the pump 10 is shown with the upper housing 16 removed to reveal the internal components of the pump 10. The ports 24, 26 of the upper housing 16, however, are shown to indicate their relative position if the upper housing 16 were present. Further, although the input shaft 32 may be rotated in either a clockwise or counterclockwise direction, for purposes of the following description the operation of the pump 10 is described wherein the input shaft 32 is rotated in a clockwise direction, as indicated by the arrow 244 in FIG. 9A.

Referring to FIGS. 9A-9D, the pump 10 is shown with the lever 120 fully rotated to an initial 0 degrees position with respect to the plane of the flanges 20. With the lever 120 in this position, the second shaft assembly 100 is oriented so that the carrier ring or secondary axis 246 is oriented at a 45 degree angle to the right of the primary axis 33, as viewed in FIG. 9C, so that the control plane 247 (FIGS. 8B and 8C) lies in a substantially horizontal plane that is generally the same or parallel to the plane of the flanges 20 which bisect the housing 12.

FIGS. 9A-9D show the primary and secondary vanes 50, 98 with the secondary vane 98 at a central intermediate position of its stroke. The forward port 26 of the upper housing 16 and the rearward port 24 of the lower housing 14 serve as discharge ports, while the rearward port 24 of the upper housing 16 and the forward port 26 of the lower housing 14 serve as intake ports. The primary and secondary vanes 50, 98 divide the spherical interior 18 of the housing into four chambers, as defined by the spaces between the primary and secondary vanes 50, 98 designated at 248, 250. Although not visible, corresponding spaces or chambers would be present in the lower housing half 14.

Figure 9C:
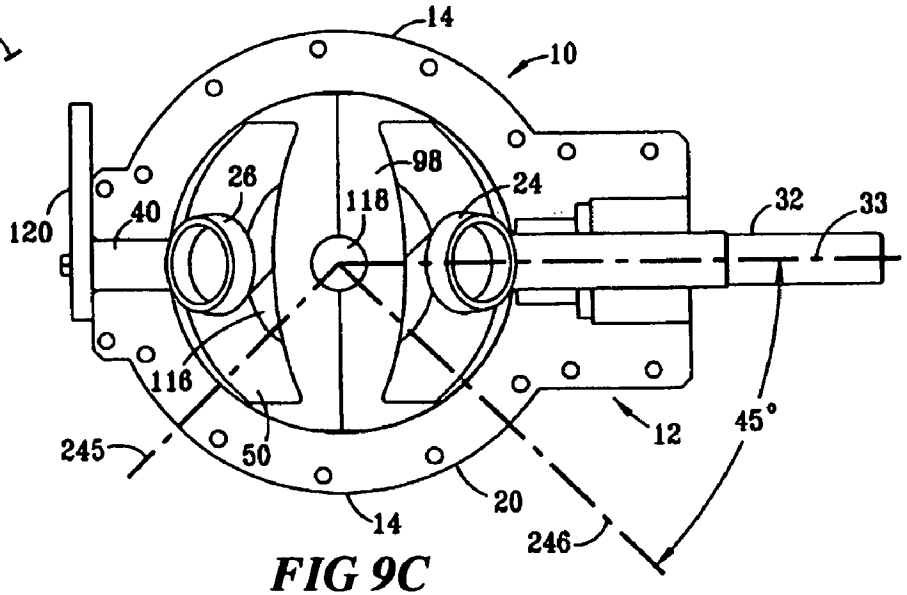
FIG. 9C is a top plan view of the pump of FIG. 9A.
Figure 9D:
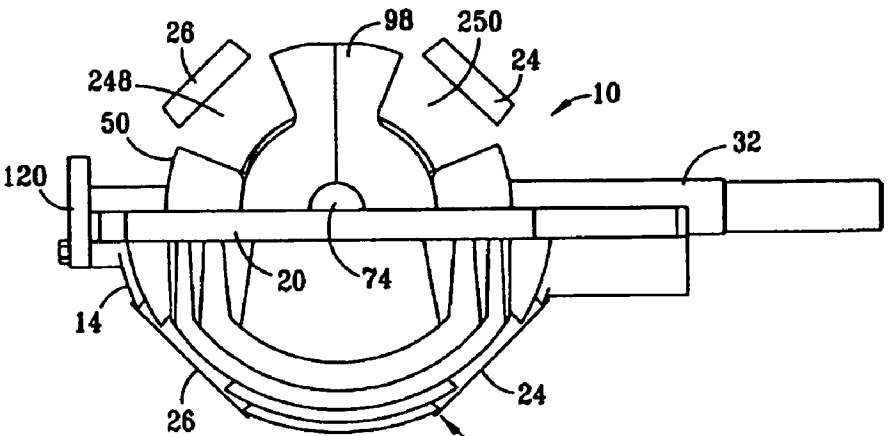
FIG. 9D is a side elevational view of the pump of FIG. 9A.
Figure 9A:
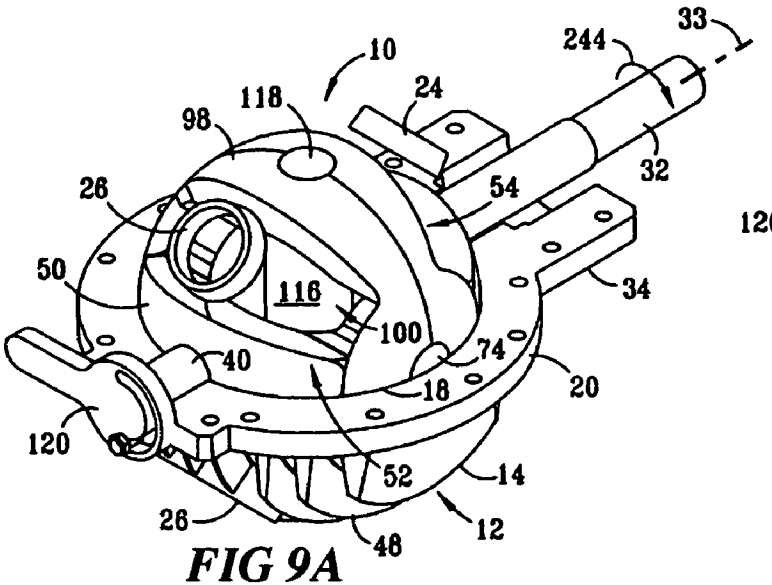
FIG. 9A is a perspective view of the pump of FIG. 1 shown with the upper half of the housing removed and the control lever in a 0 degree position.
Figure 9B:
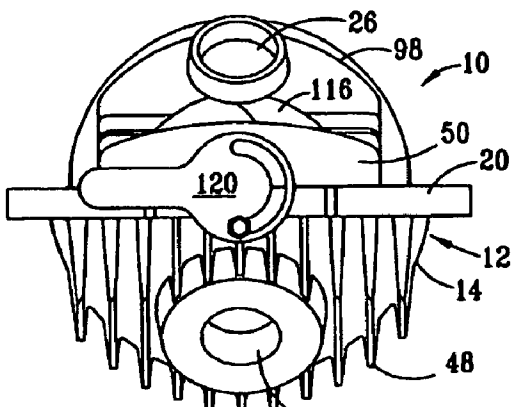
FIG. 9B is a front elevatiorial view of the pump of FIG. 9A.

FIGS. 10A-10E show sequenced views of the pump 10 in operation with the control lever 120 in the 0 degree position as the input shaft 32 is rotated through 180 degrees of revolution. For ease in describing the operation, the opposing secondary vanes are labeled 98A, 98B, with the opposing primary vanes being designated 50A, 50B. As shown in FIGS. 9A and 9C, as the input shaft 32 is rotated, the primary and secondary vanes assemblies 52, 54 are rotated about the primary axis 33 within the housing interior 18. Because the secondary vane assembly 54 is pivotally mounted to the carrier ring 116 by means of pivot posts 118, the secondary vane assembly 54 causes the carrier ring 116 to rotate on the carrier ring shaft 104 (not shown) about the carrier ring axis 246. Because the carrier ring axis 246 is oriented at an oblique angle with respect to the primary axis 33, the carrier ring 116 causes each secondary vane 98A, 98B to reciprocate or move back and forth between a fully open position and a fully closed position.

FIG. 10A shows the pump 10 with the secondary vane 98A in the fully closed position with respect to primary vane 50A. In the fully closed position, the secondary vane 98A abuts against or is in close proximity to the primary vane 50A, so that the volume therebetween is minimal. In contrast, with respect to the opposing primary vane 50B, the vane 98A is in a fully open position so that the space between the vanes 98A and 50B is at its maximum. Any fluid within the space between vanes 98A, 50A is mostly fully discharged through the port 26 of the upper housing. There is a slight overlap or communication of the interfacing primary and secondary vanes 50A, 98A with the port 26 along its edge when in the fully closed position to accomplish this. In the preferred embodiment, the primary vanes 50A, 50B are sized to completely cover and seal the ports 24, 26 so that slight rotation beyond this point causes the primary vanes 50A, 50B to close off communication with the chambers 248, 250 momentarily during rotation.

FIG. 10B illustrates the pump 10 with the shaft 32 rotated approximately 45 degrees from that of FIG. 10A. Here the secondary vane 98A begins to move to the open position with respect to the primary vane 50A. This draws fluid into the opening space through the lower inlet port 26 of the lower housing 14. The secondary vane 98B also begins to move to the closed position with respect to the primary vane 50A. Fluid located in the chamber between the primary vane 50A and secondary 98 is thus compressed or forced out of the upper discharge port 26 of the upper housing 16.

In a like manner, fluid located between the secondary vane 98A and primary vane 50B is discharged through the lower port 24 (not shown) of the lower housing 14, as the secondary vane 98A begins to move to the closed position with respect to the primary vane 50B. Fluid is also drawn through the inlet port 24 of the upper housing 16 as the secondary vane 98B is moved towards an open position with respect to the primary vane 50B.

FIGS. 10C and 10D show further rotation of the shaft 32 in approximately 45-degree increments. When the second shaft assembly 100 is in the 0 degree position, the timing is such that the chambers created by the primary and secondary vanes 50, 98 remain in continuous communication with ports 24, 26 during generally the entire stroke of the vane 50 between the closed and open positions. In this way fluid continues to be drawn into or discharged from the chambers as the secondary vanes 98 are moved to either the open or closed positions during rotation of the shaft 32.

FIG. 10E shows the pump 10 after the shaft 32 is rotated 180 degree. The secondary vane 98B is in the fully closed position with respect to the primary vane 50A, just as the secondary vane 98A was when the shaft 32 was at the 0 degree position in FIG. 10A. By continuing to rotate the shaft 32, the process is repeated so that the fluid is taken into the pump, compressed and discharged by the reciprocation of the secondary vane between the open and closed positions, which is caused by the rotation of the carrier ring 116 about its oblique carrier ring axis 246.

Figure 11C:
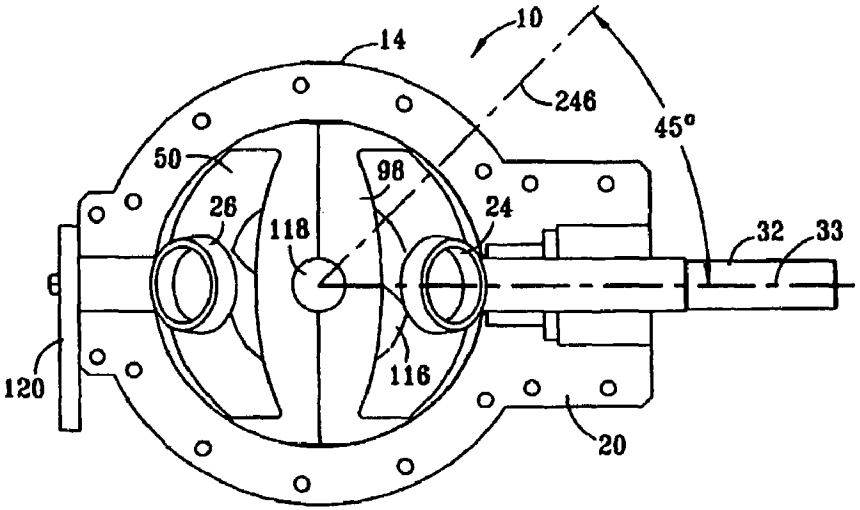
FIG. 11C is a top plan view of the pump of FIG. 11A.
Figure 11D:
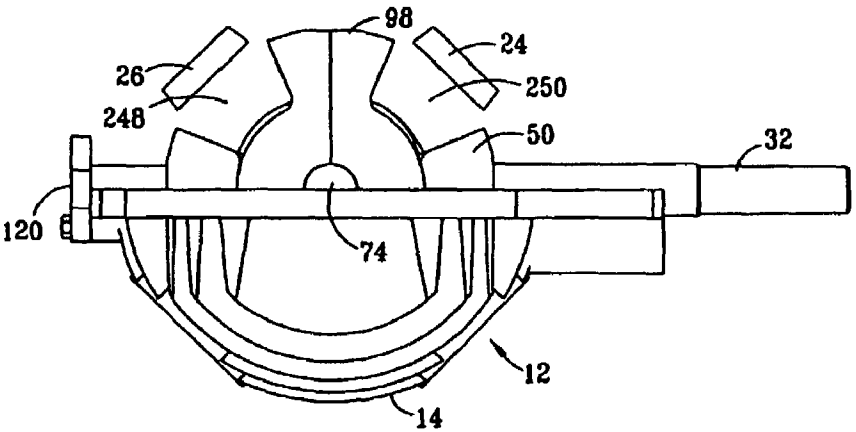
FIG. 11D is a side elevational view of the pump of FIG. 11A.
Figure 11A:
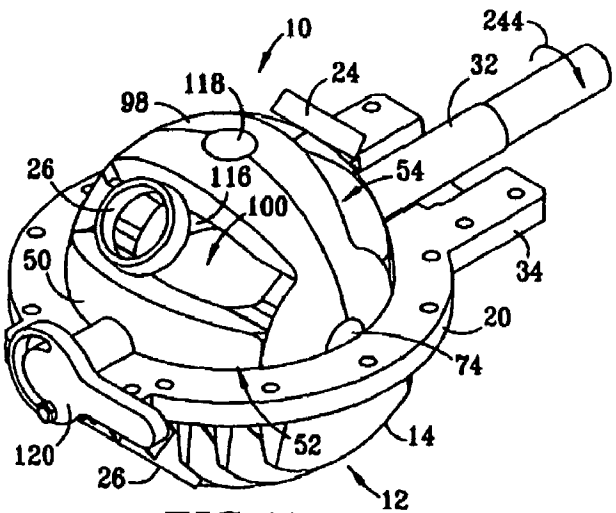
FIG. 11A is a perspective view of the pump of FIG. 1 shown with the upper half of the housing removed and the control lever in a 180-degree position.
Figure 11B:
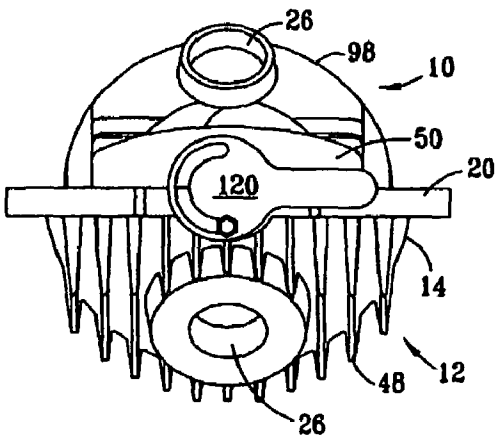
FIG. 11B is a front elevational view of the pump of FIG. 11A.
Figure 13C:
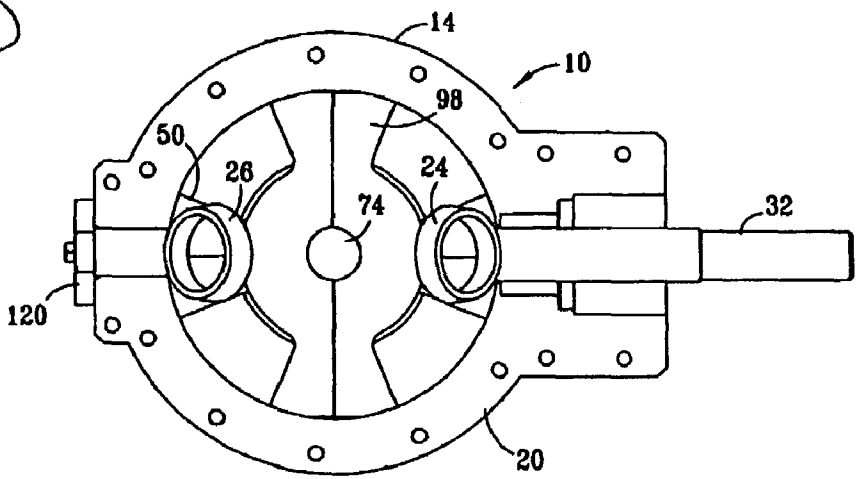
FIG. 13C is a top plan view of the pump of FIG. 13A.
Figure 13D:
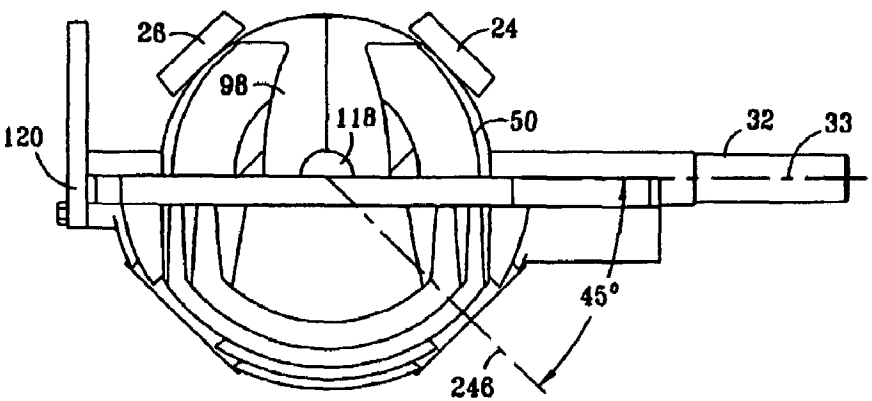
FIG. 13D is a side elevational view of the pump of FIG. 13A.
Figure 13A:
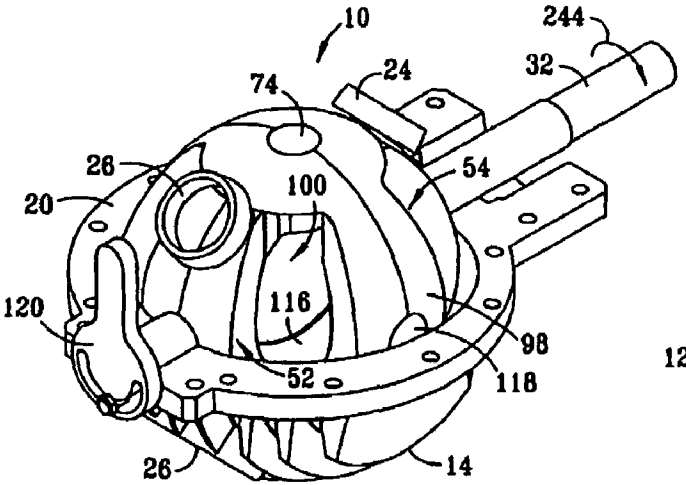
FIG. 13A is a perspective view of the pump of FIG. 1 shown with the upper half of the housing removed and the control lever in a 90 degree or neutral position.
Figure 13B:
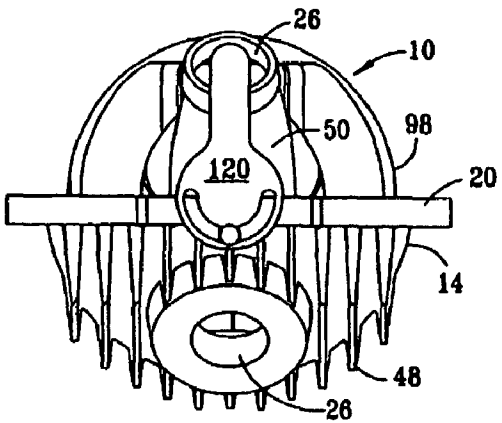
FIG. 13B is a front elevational view of the pump of FIG. 13A.

By rotating the fixed second shaft assembly 100 to different fixed positions, the flow of fluid through the pump 10 can be adjusted and even reversed without changing the direction of rotation of the input shaft 32. FIG. 11A shows the pump 10 with the lever 120 rotated fully 180 degrees from the 0 degree position of FIGS. 9A-9D. In this position, the second shaft assembly 100 is oriented so that the carrier ring axis 246 is oriented at an approximately 45 degree angle to the left of the primary axis 33, as viewed in FIG. 11C, or about 90 degrees from that orientation of the axis 246 as shown in FIG. 9C. In this position, the control plane 247 lies in a substantially horizontal plane that is generally the same or parallel to the plane of the flanges 20 which bisect the housing 12.

In the configuration of FIGS. 11A-11D, the forward port 26 of the upper housing 16 and the port 24 of the lower housing 14 serve as intake ports, while the port 24 of the upper housing 16 and the port 26 of the lower housing 14 serve as discharge ports.

FIGS. 12A-12E show sequenced views of the pump 10, with the control lever 120 rotated to the 180 degree position, as the input shaft 32 is rotated through 180 degrees of rotation. In FIG. 12A, the pump 10 is shown with the secondary vane 98A in the fully closed position against the primary vane 50A. The vane 98A is also in a fully open position with respect to primary vane 50B. Referring to FIG. 12B, as the input shaft 32 is rotated, as shown by the arrow, the secondary vane 98A begins to move to the open position with respect to the primary vane 50A. The space or chamber formed between the secondary vane 98A and vane 50A is in continuous communication with the port 26 of the upper housing 16 as it is moved to the open position. The increasing volume of this chamber as the shaft 32 is rotated, as shown in FIGS. 12C and 12D, draws fluid through the upper forward port 26. As this is occurring, the secondary vane 98B moves to the closed position with respect to the primary vane 50A forcing fluid between these vanes 98B, 50A through the forward port 26 of the lower housing 14.

FIG. 12E shows the pump after the shaft 32 is rotated 180 degrees. The secondary vane 98B is now in the closed position with respect to the primary vane 50A so that the process can be repeated. With the lever 120 in the 180 degree position, fluid is also discharged through rearward port 24 in the upper housing 16 and introduced through rearward port 24 of the lower housing 14 in the similar manner as that already described with respect to the forward ports 26. The ports 24, 26 remain in generally constant communication with one of the chambers created by the vanes 50, 98 during the entire stroke of the vane 98 between the open and closed positions.

FIGS. 13A-13D illustrate the pump 10 in an intermediate or neutral mode, with the control lever 120 oriented at an upright 90 degree position. In this position, the second shaft assembly 100 is oriented so that the carrier ring axis 246 lies in a plane perpendicular to the housing flanges 20 and is oriented at an angle of 45 degree below the primary axis 33, as viewed in FIG. 13D. In this orientation, the control plane 247 is in the 90 degree or vertical position, as seen in FIG. 8C. In this mode, the ports 24, 26 only communicate approximately 50% of the time with the chambers created by the vanes 50, 98.

FIG. 14A shows the secondary vane 98 in a center or intermediate position, with the primary vane 50 oriented so that it covers and seals the ports 24, 26. As the input shaft 32 rotates from this intermediate position, as shown in FIG. 14B, the port 26 of the upper housing 16 begins to communicate with the chamber between secondary vane 98B and primary vane 50A, and the port 26 of the lower housing 14 communicates with the chamber between the secondary vane 98A and primary vane 50A. As the secondary vane 98B is moved towards the open position with respect to the primary vane 50A, some fluid is drawn through the port 26 of the upper housing 16. In a similar manner, the secondary vane 98A is moved to the closed position with respect to the primary vane 50A so fluid therein is forced out of the lower port 26.

FIG. 14C shows the secondary vane 98B in the fully open position with respect to the primary vane 50A. The secondary vane 98A, which is hidden from view, is in the fully closed position with respect to primary vane 50A, with the closed space between the primary vane 50A and secondary vane 98A being in communication with the lower forward port 26 of the lower housing 14.

As the shaft 32 is rotated further, as seen in FIG. 14D, some fluid is forced out of the upper housing 16 through port 26 as the secondary vane 98B now moves to the closed position with respect to vane 50A. Fluid is also drawn in through the lower port 26 as the secondary vane 98A is moving to the open position in relation to the primary vane 50A.

FIG. 14E shows the pump 10 after rotation of the shaft 32 180 degrees from its original position of FIG. 14A. The secondary vane 98 is once again in the intermediate position, like that of FIG. 14A, and the process is repeated. With the control lever 120 in the 90 degree position, as described, the ports 26 of the lower and upper housing 14, 16 only communicate with the chambers defined by the primary and secondary vanes 50, 98 approximately 50% of the time. This results in equal volumes of fluid being both drawn and discharged through each of the forward ports 26 in the upper and lower housing during this neutral mode. The operation is the same with respect to the fluid flow through the rearward ports 24 in the lower and upper housing 14, 16. The net fluid flow through the pump 10 is therefore essentially zero.

By rotating the control lever 120 between the 0 degree and 180 degree positions, the fluid flow can be increased or decreased precisely in a smooth and continuous manner, and can be directed in either flow direction. This is due to the increased amount of time the inlet ports and outlet ports communicate with the chambers 248, 250 formed by the vanes 50, 98 during the expansion and compression strokes, respectively, of the secondary vane 98. Thus, for example, as the lever 120 is rotated from the 90 degree or neutral position towards the 0 degree position of FIG. 10A, the length of time the forward port 26 of the upper housing 16 communicates with the chamber formed by the primary vane 50A and secondary vanes 98, as the secondary vanes 98 are moved to the closed position, is lengthened, resulting in more and more fluid flow through this port. As described previously, when the lever is at the full 0 degree position, the port 26 of the upper housing 16 is in communication with the chamber formed by the primary vane 50A and secondary vanes 98 during almost the entire compression stroke of the secondary vanes 98 with respect to the vane 50A so that full flow is achieved when the pump 10 is in this mode. Similar results in the reverse-flow direction are achieved by rotating the lever 120 between the 90-degree and the 180-degree position, which is shown in FIG. 12A.

Although not shown, other means could be provided for rotating the second shaft assembly 100. For instance, the shaft 40 could be coupled to a worm and worm gear to rotate the second shaft to various positions. This in turn could be coupled to a controller that would cause the second shaft assembly to be rotated to automatically control and adjust the fluid flow or capacity of the pump 10. In this manner the flow capacity and even the direction of flow can be automatically adjusted remotely from the fluid machine.

Figure 15:
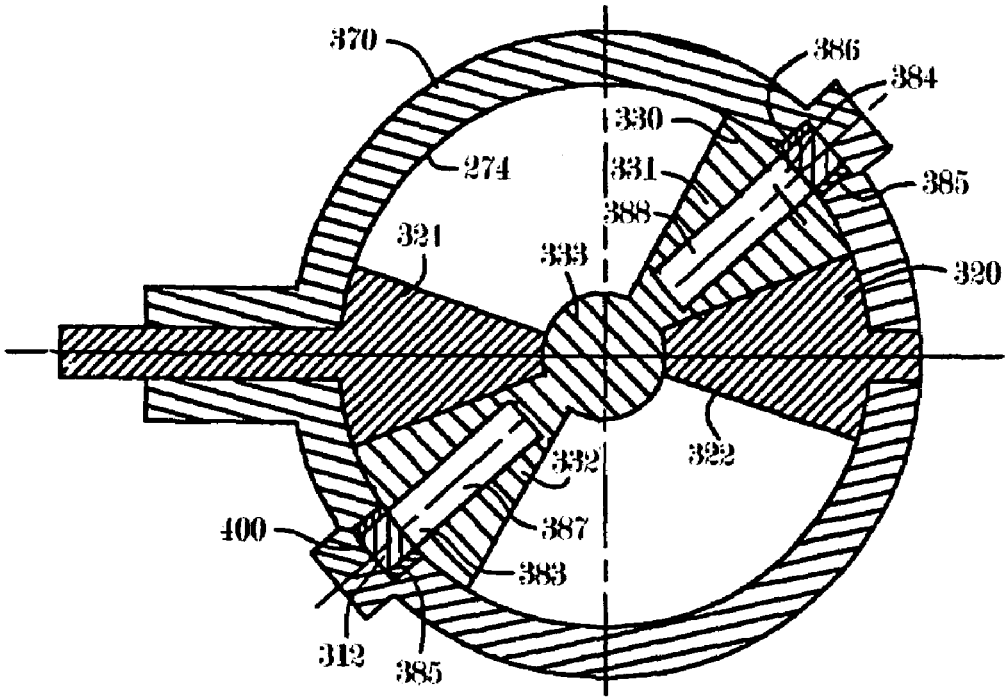
FIG. 15 is a detailed cross-sectional view of a spherical pump operating with an exterior carrier guide ring.
Figure 16:
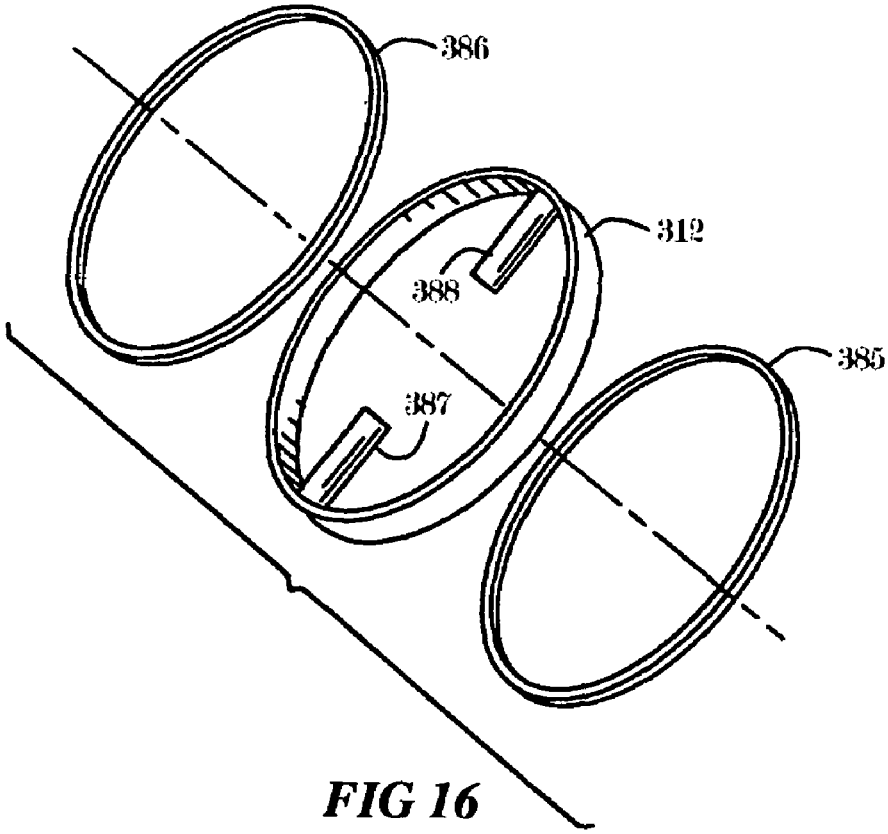
FIG. 16 is a detailed view of the exterior carrier ring of the device of FIG. 15.

The fluid machine described above is based on an internal carrier ring assembly that guides the reciprocating action of the secondary vane. Alternately, these types of spherical fluid machines can have the guide carrier ring mounted in an exterior manner. U.S. Pat. No. 5,199,864 discloses a somewhat similar pump to that of U.S. Pat. No. 6,241,493 and also describes an embodiment (the "second embodiment") that uses an exterior carrier ring to guide the reciprocal motion of the vanes. In one particular alternative embodiment (the "second" embodiment) which is illustrated in FIGS. 15-16, a larger diameter collar 312 having inwardly protruding spindles 387 and 388 serves as the means for controlling reciprocation of secondary member 330 relative to rotation of primary member 320. The inside diameter of collar 312 matches the inside diameter of the spherical interior surface 274 of housing 370 in order to provide a flush spherical surface. The housing 370 is modified to define an angular raceway 400 between two halves of housing 370 for receiving collar 312 therein. Also received within raceway 400 are washer-like bearings 385 and 386 for enabling rotation of collar 312 within raceway 400. The housing 370 is formed in two halves that are joined by conventional means along raceway 400 for enabling assembly of collar 312 and bearings 385 and 386 within raceway 400. A central member 333 provides the pivotal engaging surface between primary member 320 and secondary member 330.

The other features of the structure and operation of this external carrier ring design are substantially the same as in U.S. Pat. No. 6,241,493 except, of course, changes in the interior surfaces of vanes 321, 322, 331 and 332 are preferably modified to accommodate central member 133. Similarly, the housing 370 of the second embodiment is modified to accommodate for raceway 400 therein, to produce the construction shown in FIG. 15. Many of the improvement embodiments of the instant invention have application in this type of exterior carrier ring design also.

These prior art fluid devices have several advantages. As pumps they are highly efficient, pumping substantially twice the free volume of the pump interior for every revolution of the input shaft, when used in the full flow mode. The devices do not need to be primed, as in many prior art devices. They can be used for many different applications and with a variety of different fluids, both compressible and non-compressible. They can be used as vacuum pumps. The devices may even be used as motors.

Figure 17:
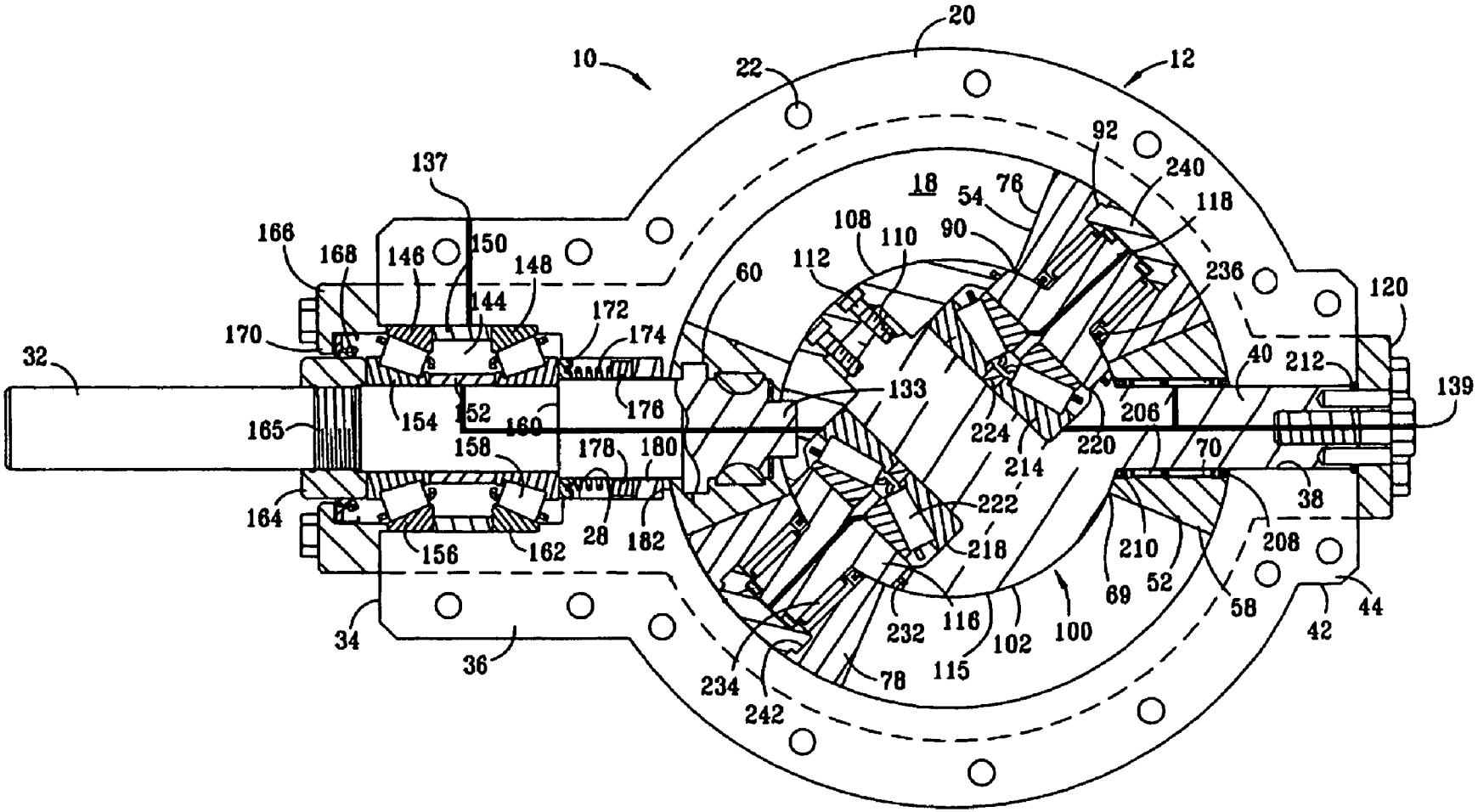
FIG. 17 is a detailed cross-sectional view of the pump of FIG. 1 showing added structure to improve rigidity and the addition of internal coolant-lubricant lines.
Figure 18:
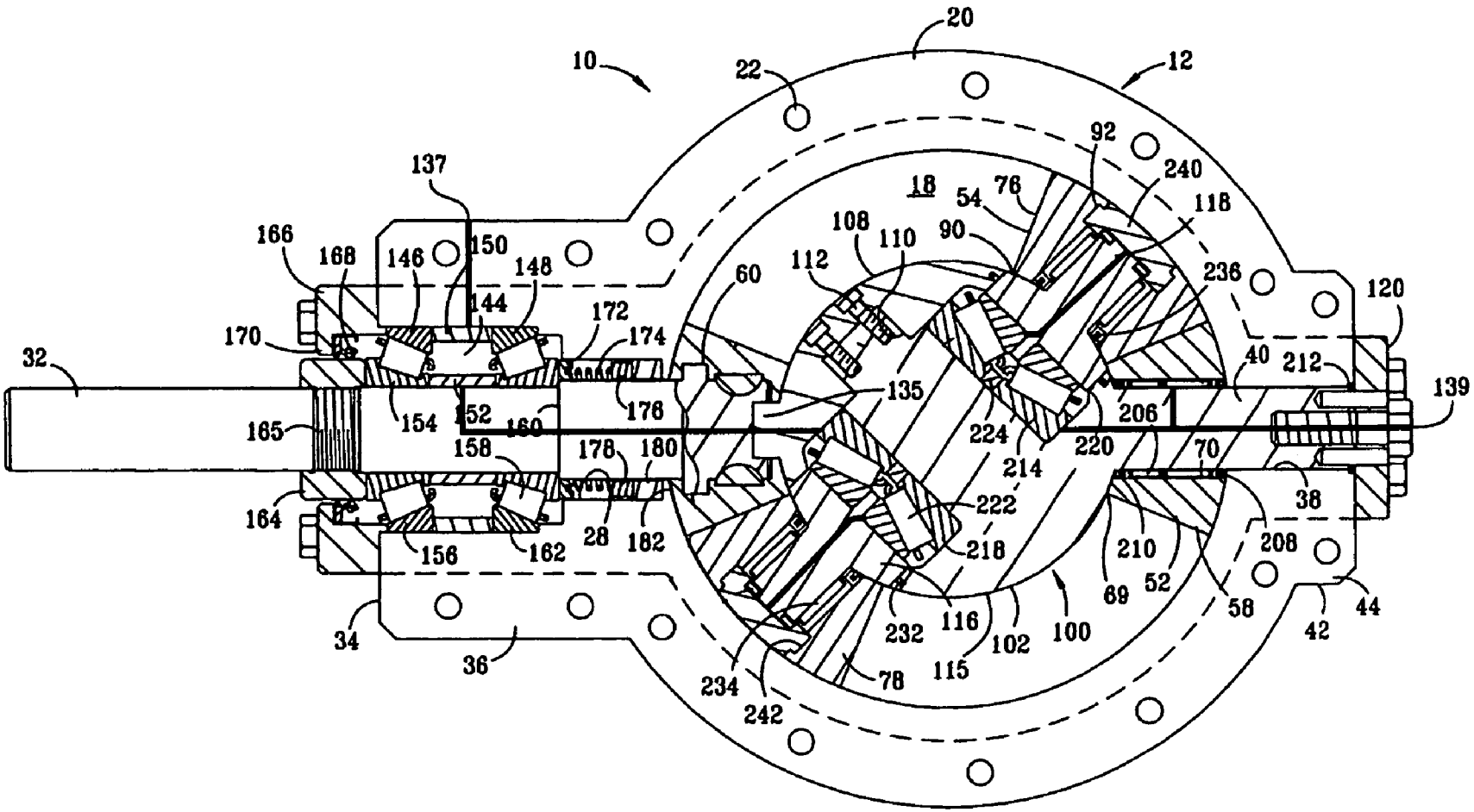
FIG. 18 is a detailed cross-sectional view of the pump of FIG. 1 showing a different embodiment of added structure to improve rigidity and the addition of internal coolant-lubricant lines.

As mentioned previously the prior art fluid machines just described, while having many advantages, do have issues in some applications. Because there is no contact between the vanes and both the internal sphere and the housing of the machine, the fluid machine just described has the potential for long life during use. In constant use however instabilities can occur that result in vibration of the internal structures, causing for example unwanted interference between the exterior surfaces of vanes 52, 54 and the interior of housing 12 and/or the exterior surfaces of spherical portion 102 and the end cap 108. Accordingly there is a need for improved rigidity of the internal structure of the fluid machine. FIG. 17 shows a design change that is part of the instant invention that significantly improves the rigidity of the internal structure of the fluid machine. At the interior end of rotating shaft 32 a nipple 133 is extended into the end cap 108 and rotatably attached by means of a suitable bearing assembly (not shown). This extended nipple provides significantly improved rigidity to the design without significantly increasing the load on the rotating shaft. The extended nipple also allows the inclusion of a pathway for a lubricating coolant fluid to and through the central ball 115 that is another part of the instant invention. Alternately the desired rigidity can be supplied by an extension 135 from the central ball 115 attached rotatably to rotary shaft 32 as shown in FIG. 18. It should be recognized that the rigidity desired from this change could also be achieved by related mechanical implementations, such as a sleeve extending from the central ball 115 and encircling the rotary shaft 32 with appropriate bearing assembly to maintain the shaft as rotatable, or such as a rotatable coupling between the primary vane 50A and end cap 108. These latter two versions of the rigidity solution are not shown in the drawings.

The use of the prior art fluid machine described earlier as a gas compressor can lead to operations in which the interior temperature of the fluid machine rises significantly due to the heat generated by the compression of gases. Because there is minimal heat conduction pathways between the internal ball and the pump housing where the exterior vanes can carry off heat there is a need for another form of heat removal. Accordingly, in another embodiment the addition of the extended nipple 133 or the extension 135 just described provides a connection for a fluid pathway that allows the circulation of a lubricating cooling fluid through the interior ball of the fluid machine. FIG. 17 and FIG. 18 show such a solution, with a lubricating cooling line running through the rotary shaft, filling the interior sections of the central ball 115, including all the bearing assemblies, and then flowing out through second shaft 40. This is shown as the dark lines beginning at point 137 and exiting shaft 40 at point 139.

In another embodiment to address the removal of heat from the central ball of the fluid machine of the prior art an improved thermal conduction pathway from the central ball is created by providing metallic seals between the two vanes and the central ball and metallic seals between the two vanes and the fluid machine housing. In the case of metallic fluid machines there is then a thermal conduction pathway all the way from the central ball to the fluid machine exterior and the finned exterior that provides much improved cooling of the central ball. The use of such seals provides additional benefit in eliminating blow-by of compressed gases between the suction and compression side of the fluid machine. Also, to inhibit fluid leakage and with reference to FIG. 3 and FIG. 4, preferably seals are provided (but not shown) between the stub shaft 74 and the recesses 94; likewise seals are provided (but not shown) between the stub shaft 96 and the recesses 72, between the outer side edges 73 of primary vane halves 56, 58 and inner side edges 89 of secondary vane halves 76, 78, and between narrow ridges 83 of the secondary vane halves 76, 78 and the hinge portions 66, 68 of primary vane halves 56, 58. It should be recognized that such seals could be made from high performance plastic or elastomeric materials if the sealing function is more important than the heat transfer issues. Alternatively, the seals of this embodiment may be brush seals or labyrinth seals, both of which are commonly known. Further, the seals of this embodiment when used for the flowing of compressible fluids may be augmented and/or replaced with the introduction of a relatively incompressible fluid, such as lubricating oil or water, into the ports 24, 26 of the fluid machine.

Figure 19:
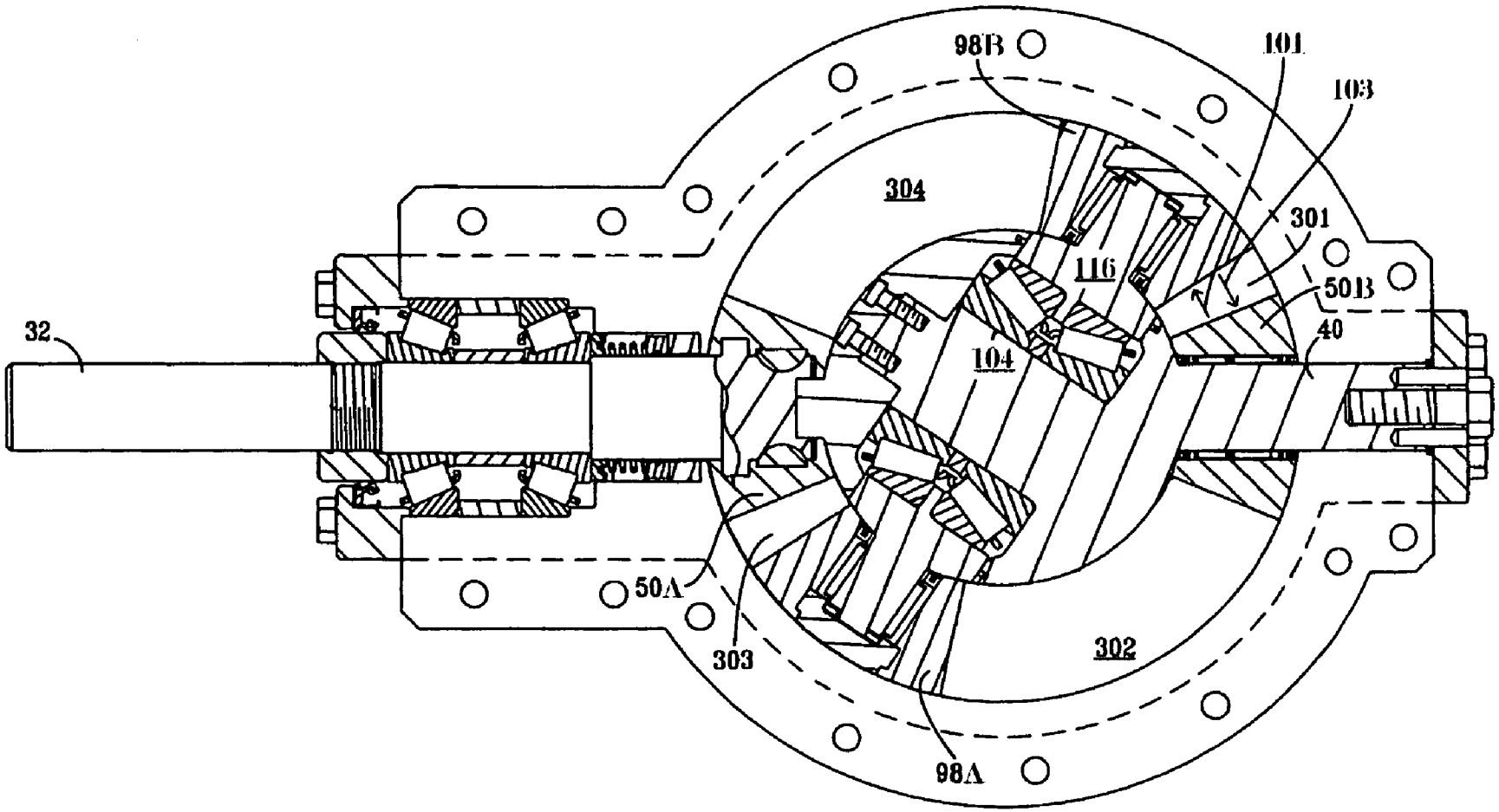
FIG. 19 is a cross-sectional view of the pump of FIG. 1, showing an embodiment providing balanced forces across a secondary vane as the secondary vane approaches the relatively closed position with respect to the primary vane.

The use of the prior art machine as described earlier was limited in that it did not provide for balancing forces upon the secondary vane as it neared the relatively closed position with respect to the primary vane. As shown in FIG. 19, secondary vane 98B is approaching the relatively closed position with respect to primary vane 50B. The pressure of the fluid being pressurized in chamber 301 exerts a force depicted in the general direction 101, which pressure force was not balanced in prior art machines by the force depicted in the general direction 103 which latter force is due to the slowing of momentum of secondary vane 98B. In an embodiment of the present invention, the weight or density of secondary vane 98B is adjusted to balance momentum force 103 with pressure force 101, which lowers the wear on the interfacing surfaces and bearings between secondary vanes 98A, 98B and the carrier ring 116, and between the carrier ring 116 and the carrier ring shaft 104. This adjustment of weight or density may be accomplished by any combination of the following means: selection of materials of differing densities or composite combination of materials which combination achieves differing densities, and/or void spaces in the vanes.

The use of the prior art machine as described earlier was limited in that it did not provide for increasing the stored momentum energy in the primary vane. In an embodiment of the present invention, the weight or density of the primary vane 52 is made heavy relative to the weight or density of the secondary vane 54, allowing the aforementioned rotation of the primary vane 52 about the input shaft 32 to provide additional stored momentum energy, which additionally energy is advantageous in the efficient operation and smooth operation of the fluid machine.

The use of the prior art machine as described earlier was limited to flowing a single fluid through the machine. In another embodiment of the instant invention, multiple fluids are caused to flow through the same machine. FIGS. 20A-20E show sequenced views of the pump 10 in operation with the control lever 120 in the 0 degree position as the input shaft 32 is rotated through 180 degrees of revolution and while simultaneously flowing two fluids through its interior. For conceptual convenience, the majority of the lower housing half 14 is not shown. As discussed with FIGS. 10A-10E, motion of the input shaft 32 causes each secondary vane 98A, 98B to reciprocate or move back and forth between a fully open position and a fully closed position with respect to primary vanes 50A, 50B. Chamber 301 is defined as the space between primary vane 50B and secondary vane 98B, chamber 302 is defined as the space between primary vane 50B and secondary vane 98A, chamber 303 is defined as the space between primary vane 50A and secondary vane 98A and chamber 304 is defined as the space between primary vane 50A and secondary vane 98B.

In the depicted embodiment, simultaneous flow of two fluids is accomplished by connecting upper port 24 to a first fluid source and lower port 26 to a second fluid source. Lower port 24 acts as an outlet for the first fluid and upper port 26 acts as an outlet for the second fluid. FIG. 20F shows that concept by showing the port openings only. First fluid 196 enters upper port opening 24 and exits lower port opening 24. Second fluid 196 enters lower port opening 26 and exits upper port opening 26. In the sequences shown in FIGS. 20A-20E, the first fluid flows from the first fluid source through upper port 24 into chamber 301, and from chamber 302 out of lower port 24. Simultaneously, the second fluid flows from the second fluid source through lower port 26 into chamber 303, and from chamber 304 out of upper port 26. This separation of flows of the two fluids is facilitated by the previously discussed seals between the vanes and the interior of the housing 12, between the vanes and the exterior of the central ball 115, and between the primary vanes 50A, 50B and secondary vanes 98A, 98B.

In similar manner as described for FIGS. 20A-20E, as the input shaft 32 is rotated through another 180 degrees of rotation, first fluid flows from the first fluid source through upper port 24 into chamber 302, and from chamber 301 out of lower port 24. Simultaneously, the second fluid flows from the second fluid source through lower port 26 into chamber 304, and from chamber 303 out of upper port 26. In the depicted embodiment, chambers 301 and 302 transfer only the first fluid through upper and lower ports 24, and chambers 303 and 304 transfer only the second fluid through upper and lower ports 26.

Another embodiment utilizing the simultaneous flow of two fluids combines dual use of the fluid machine as both a pump/compressor/vacuum and also as a motor simultaneously. As an example of this dual use, the first fluid introduced through upper port 24 may be a compressed gas, the expansion of which moves the secondary vanes 98A, 98B, which in turn both rotates the carrier ring 116 about the carrier ring rotational axis and rotates the primary vanes 50A, 50B about the primary vane rotational axis. This motion in turn powers the movement of the second fluid introduced through lower port 26. In this embodiment, the two fluids need not be different fluids, but may be the same fluid serving the dual purposes of pumped fluid and power-providing fluid.

The spherical fluid machine of the prior art is highly versatile in that it can operate as a fluid pump or a gas compressor. In still another embodiment utilizing the simultaneous flow of two fluids, the pump provides two flows of different compression ratios. This is accomplished by varying the ratio of maximum to minimum volumes of at least one of the chambers in communication with the first fluid source compared to the ratio of maximum to minimum volumes of at least one of the chambers in communication with the second fluid source. In this embodiment, the two fluids are not necessarily different in composition, but may for example be the same gas compressed to two different compression ratios.

Figure 21:
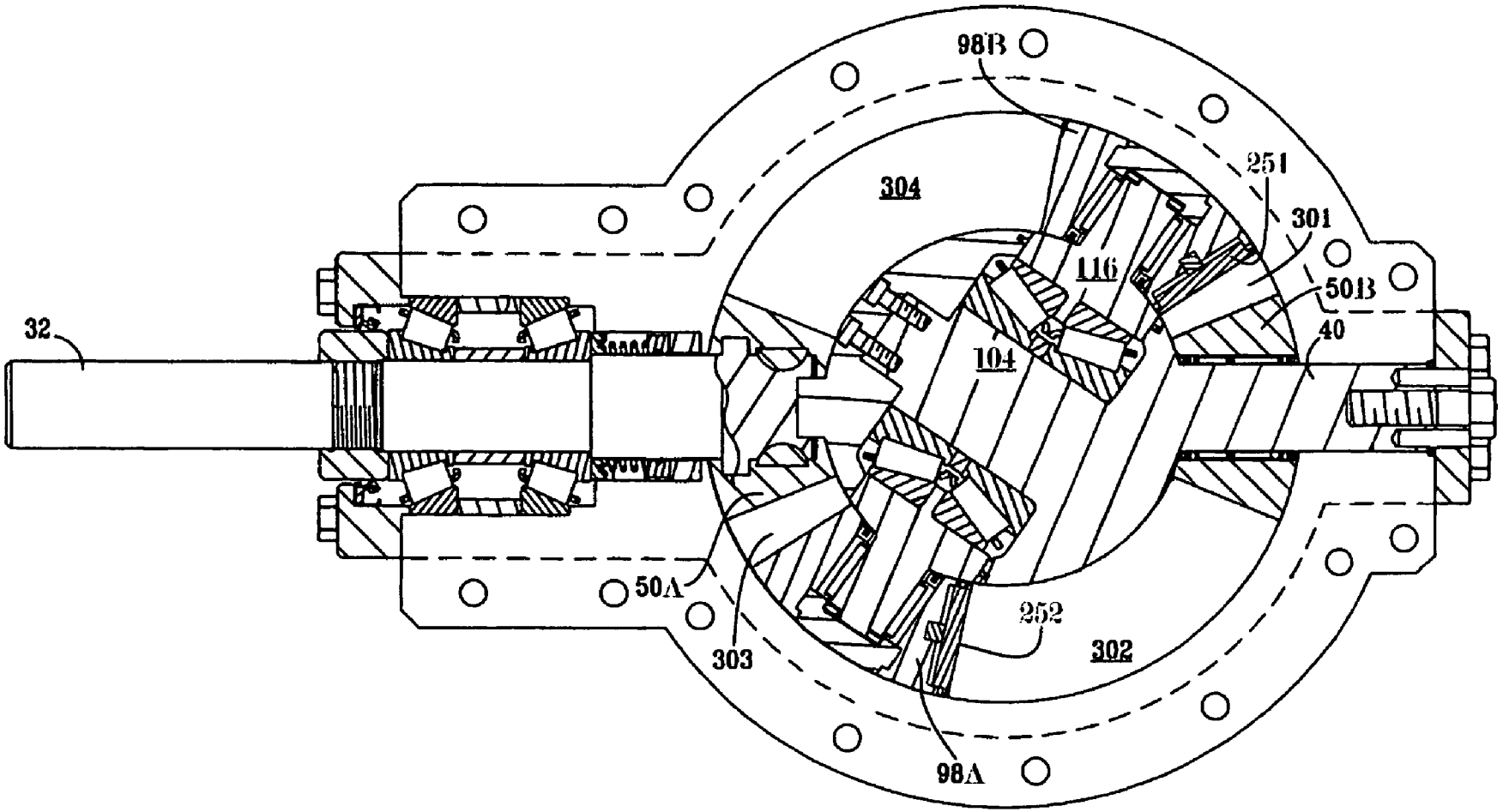
FIG. 21 is a cross-sectional view of the pump of FIG. 1, showing an embodiment providing multiple compression ratios.

One embodiment for varying said compression ratios is depicted in FIG. 21. The longitudinal axis of the carrier ring shaft 104 is oriented at an oblique angle of 35 degrees with respect to the axis of second shaft 40, instead of an oblique angle of 45 degrees as shown in FIG. 8B. This increases the minimum size of chambers 301-304 as primary vanes 50A, 50B rotate about the axis of input shaft 32 while pivotally moving secondary vanes 98A, 98B between relatively open and closed positions with respect to primary vanes 50A, 50B. Compression adjuster plate 251 is attached to secondary vane 98B on the side facing primary vane 50B, reducing the minimum volume of chamber 301. Compression adjuster plate 252, which is preferably but not necessarily the same volume as compression adjuster plate 251, is attached to secondary vane 98A on the side facing primary vane 50B, reducing the minimum volume of chamber 302. In this manner, the compression ratios of all four chambers may be altered independently. The compression ratios of any or all of the chambers may be altered by any of various methods apparent to one skilled in the art, including the fastening of compression adjuster plates to the primary vane, the altering of the shape or width of any of the vanes 50A, 5B or 98A, 98B by attachments or by movable plates attached to inflatable bladders or hydraulic cylinders for example hydraulically inflated or expanded by the cooling fluid via channels as previously mentioned, or combinations thereof, all with or without the altering of the angle formed between carrier ring shaft 104 and shaft 40. For an embodiment flowing two gas streams, the inventive fluid machine provides different compression ratios to the two gas streams simultaneously.

Figure 22:
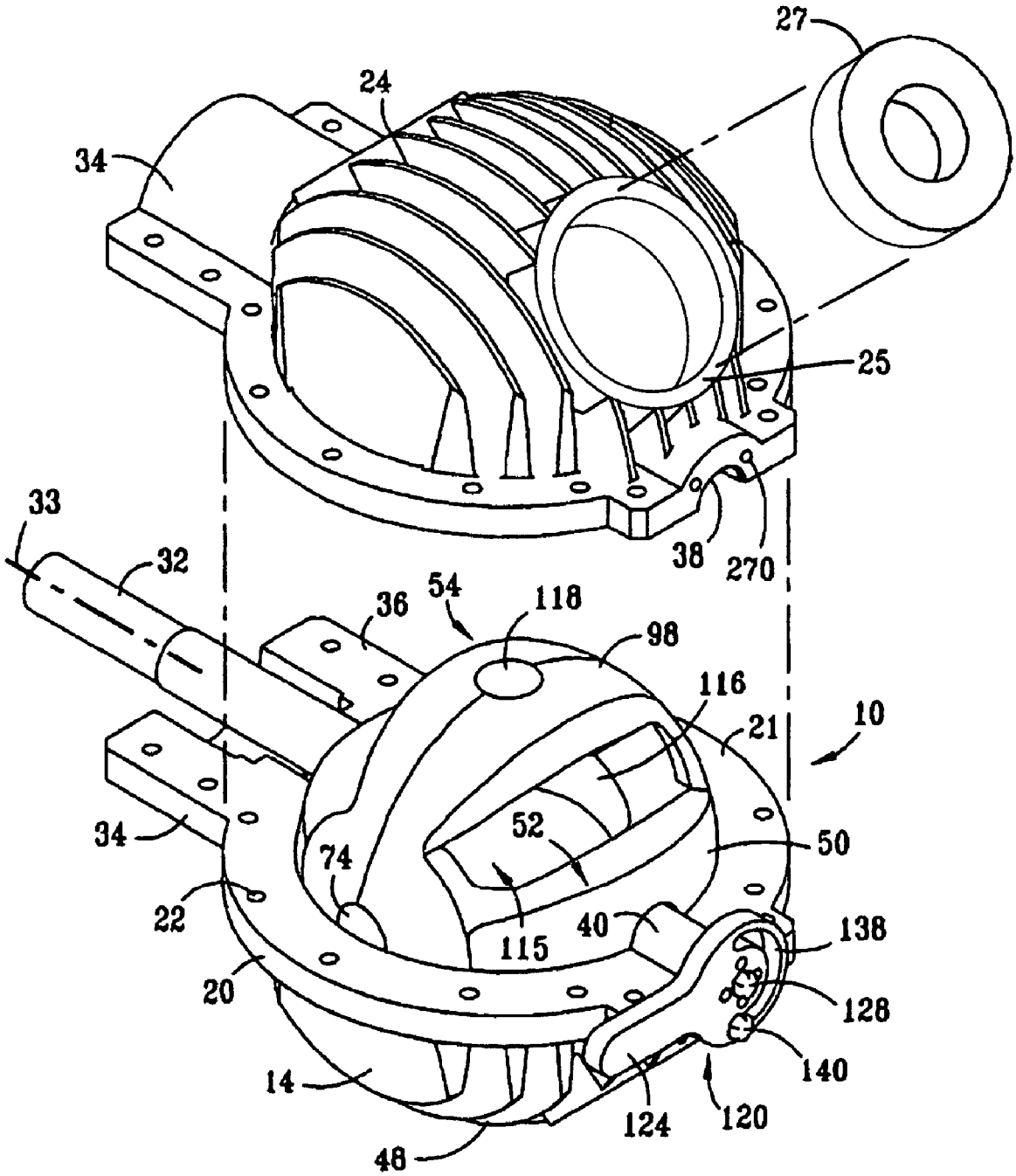
FIG. 22 is a front perspective view of a fluid machine similar to FIG. 1 but showing the embodiment of a port insert.
Figure 23B:
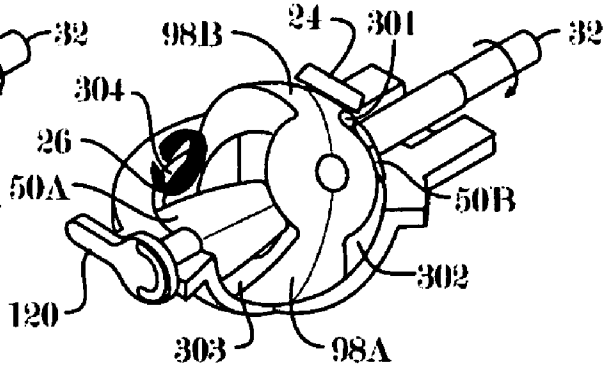
FIGS. 23A-23E are sequenced perspective views of the pump of FIGS. 9A-9D with the control lever in the 0 degree position, as the rotary shaft of the pump is rotated 180 degree during the pump's operation, showing the simultaneous flow of two fluid streams at two different flow rates through the pump.
Figure 23A:
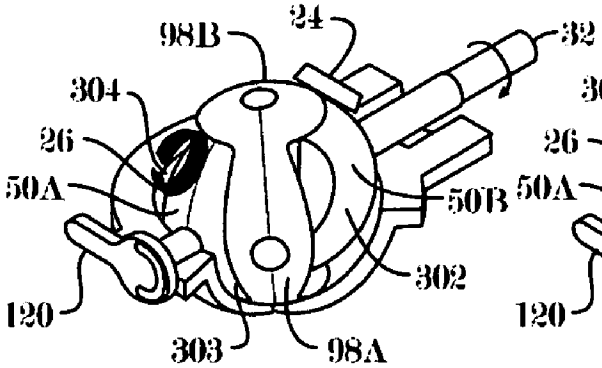
Figure 23E:
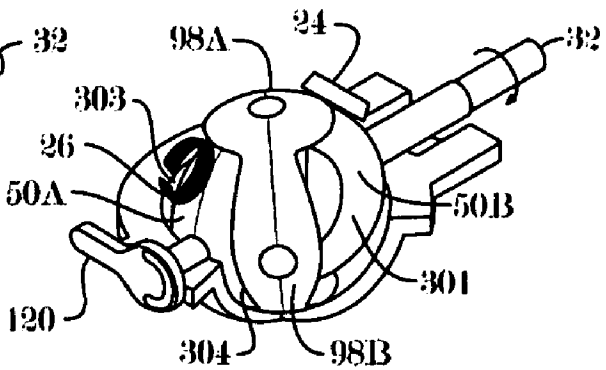
Figure 23D:
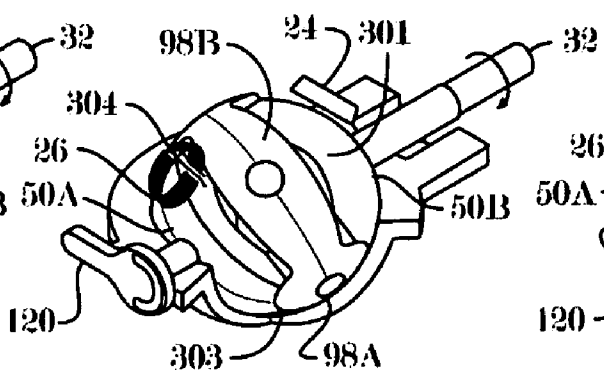
Figure 23C:
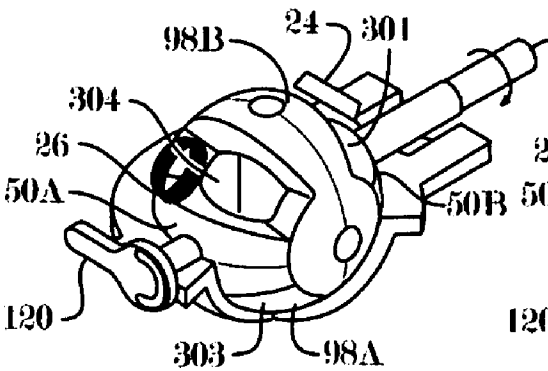

Also when the fluid machine is used as a compressor the port size is purposely made small and/or narrow with respect to the gap between vanes 52 and 54, to ensure good compression performance. When the same fluid machine is needed to pump mostly incompressible fluids a larger port size or broader port width is needed to ensure that there is communication between the outlet port and the compression chambers during the entire compression cycle to avoid fluid locking of the pump. This adaptability can be provided by providing the fluid machine a port or ports with sizes and/or shapes to accommodate incompressible fluids. That normal port can then be altered to a smaller size and/or narrower shape to ensure good compression performance when moving compressible fluids such as gases. That change in port size and/or shape can be provided by a number of design choices. A preferred embodiment would be the use of a port insert that could be field installed when changing the fluid machine from a hydraulic fluid pump to a gas compressor. FIG. 22 demonstrates the addition of a port insert 27 into port 25. This port insert could be tightly attached by any number of methods including but not limited to pins, screws, clamps, etc.

The use of the prior art machine as described earlier was limited to flowing two streams of fluid through the machine at only the same flow rate. In another embodiment of the instant invention, FIGS. 23A-23E show sequenced views of the pump 10 in operation with the control lever 120 in the 0 degree position as the input shaft 32 is rotated through 180 degrees of revolution and while simultaneously flowing two fluid streams at two different flow rates through its interior. For conceptual convenience, the majority of the lower housing half is not shown. As discussed with FIGS. 20A-20E, motion of the input shaft 32 causes each secondary vane 98A, 98B to reciprocate or move back and forth between a fully open position and a fully closed position with respect to primary vanes 50A, 50B, varying the volumes of chambers 301-304 as previously defined. Simultaneous flow of multiple fluid streams at different flow rates is accomplished by rotating ports 26 about the axis of input shaft 32 in relationship to ports 24. In the depicted embodiment, ports 26 are rotated 20 degrees about the axis of input shaft 32. Upper port 24 is connected to a first fluid source and lower port 26 to a second fluid source. Lower port 24 acts as an outlet for the first fluid and upper port 26 acts as an outlet for the second fluid. In this embodiment, the first and second fluid may be either the same fluid or different fluids. In the sequences shown in FIGS. 23A-23E, the net flow rate of second fluid from the second fluid source through lower port 26 has been decreased, due to the altering of the position of ports 26 with respect to the opening and closing of the secondary vanes 98A, 98B with respect to primary vanes 50A, 50B, in a manner similar to that previously described when second shaft assembly 100 is rotated to various fixed positions as described for the sequences in FIGS. 10A-10E, 12A-12E, 14A-14E.

Figure 24:
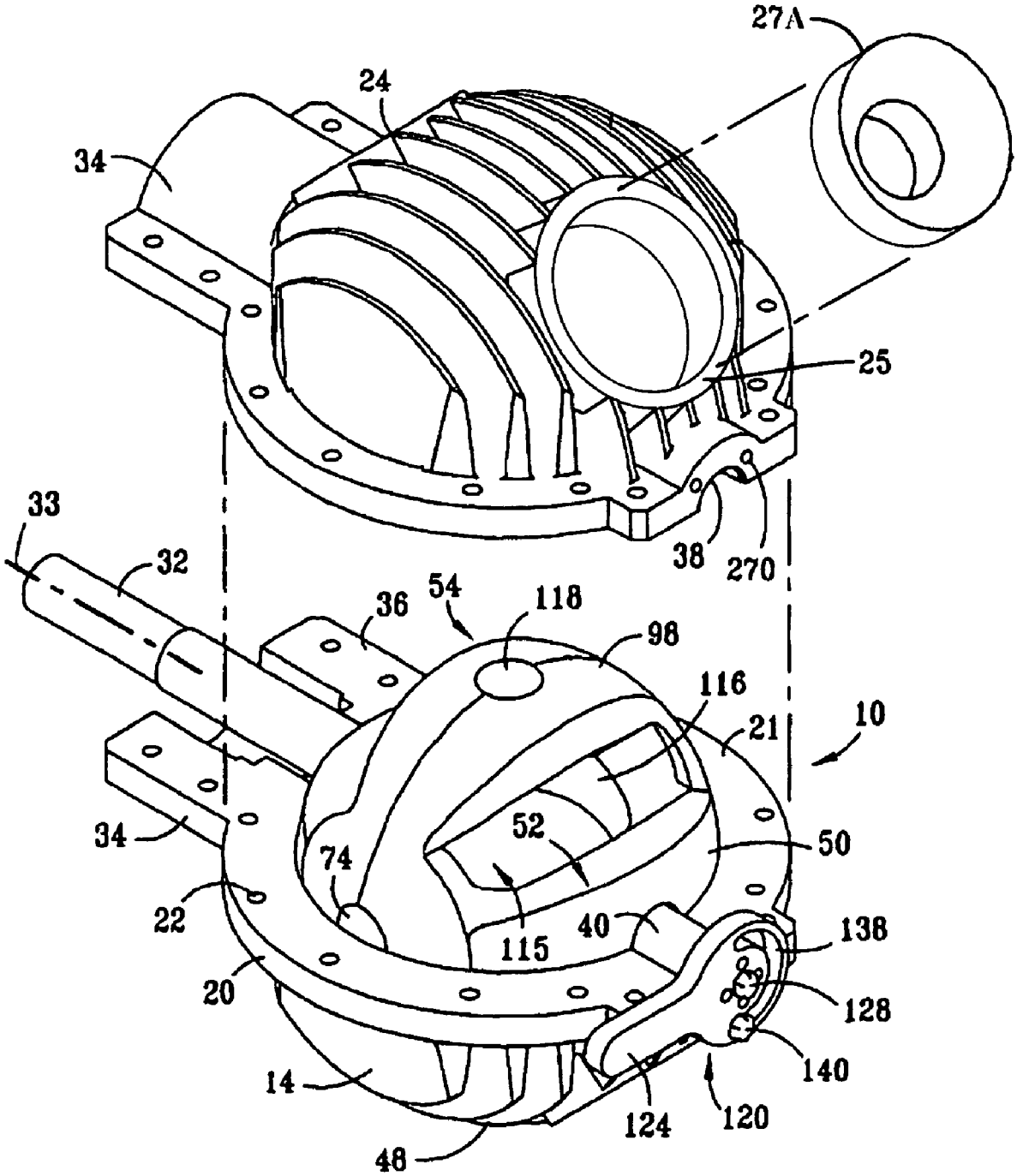
FIG. 24 is a front perspective view of a fluid machine similar to FIG. 1 but showing the embodiment of an eccentric port insert.
Figure 25:
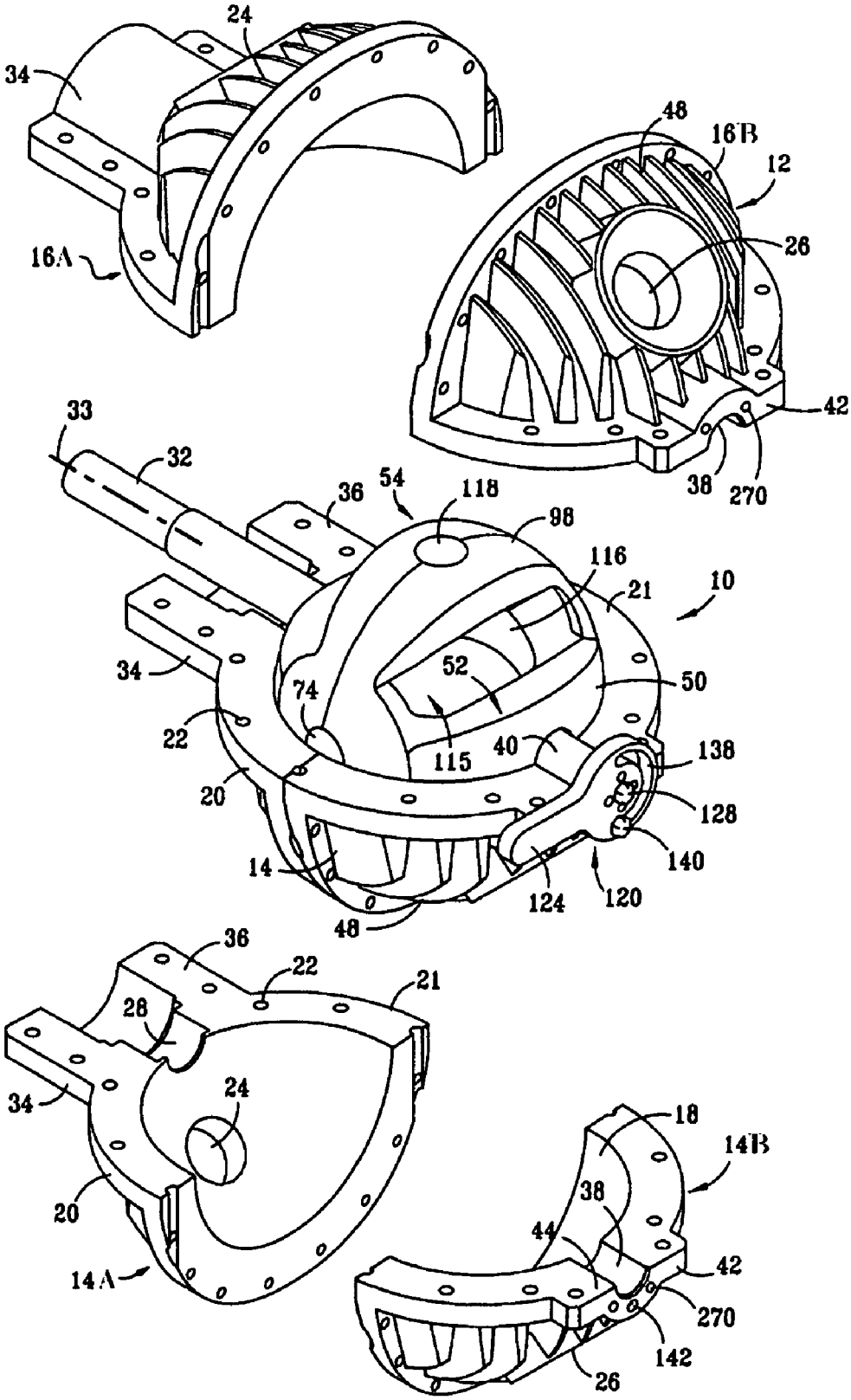
FIG. 25 is a front perspective view of a fluid pump, shown with the upper and lower halves of the housing of the pump exploded away and divided into quarters, and internal components of the device removed.

In this embodiment, rotating the position of ports 26 about the axis of the input shaft 32 in relationship to ports 24 may be accomplished through several means. One such means would be to provide eccentric port inserts 27A as shown in FIG. 24. Both upper and lower ports 26 are rotated in this manner to a similar extent, to avoid fluid locking of the fluid machine. This insert means may also be alternatively employed with the carrier ring on the outside of the housing interior, as taught by Stecklein in U.S. Pat. No. 5,199,864. As shown in FIG. 25, another such means is to divide housing halves 14, 16 into quarter sections 14A, 14B, 16A, 16B along the plane perpendicular to the axis of input shaft 32 and intersecting the center of center ball 115. Flanges are provided to each quarter section to allow sealing of quarter sections 14A, 16A to quarter sections 14B, 16B after rotation of ports 24 to a new fixed position (for example, by rotating quarter sections 14B, 16B about the axis of input shaft 32). Additional means of rotating ports 24 about the axis of input shaft 32 relative to ports 26 may also be employed, as readily apparent to those skilled in the art. This embodiment may be implemented independent of or in combination with any number of the above mentioned embodiments that provide for flow of multiple fluids, that provide for simultaneous multiple compression ratios, that provide for removal of heat from the interior of the pump, that provide for changeable ports to change use between pump and compressor, or that provide for stabilization of the structure.

Additional embodiments that independently vary the relative flow rates through at least two ports are possible as evident to one skilled in the art. These include altering the shape or one or more face angles of any of the vanes 50A, 50B, 98A, 98B, which shape altering may optionally be accomplished by plates driven by hydraulic bladders, providing corresponding adjustments to the flow of fluid(s) through chambers 301-304. Another embodiment includes providing a path for relative one-way flow between chambers. The flow path may be through or around a vane, and is tapered or valved to preferentially allow flow in one direction.

A significant advantage of this embodiment of the present invention is that it does not require valves in the traditional sense. Valves are prone to wearing out and to becoming clogged from accumulated deposits, which are both disadvantageous for a device used on a continuous basis.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

The invention claimed is:

1. A fluid machine comprising:

a housing having a wall defining a generally spherical interior, said housing having at least one port opening in communication with said interior of said housing;

a first shaft mounted for rotation relative to said housing about a primary axis;

at least one primary vane disposed within said interior of said housing that rotates about said primary axis of said first shaft;

at least one secondary vane disposed within the interior of said housing and mounted to said primary vane on a first pivotal axis, said secondary vane pivotally oscillating between alternating relatively open and closed positions with respect to said primary vane and defining at least a chamber within said housing interior having a volume which varies as said primary vane is rotated about said primary axis;

wherein said at least one port opening is adjustable and has a first opening in continuous fluid communication with an approaching closing chamber for flowing incompressible fluids but is changed in size to a second opening for flowing compressible fluids.

2. The fluid machine of claim 1 wherein said changes in size of first and second port openings is accomplished by a port inserts.

3. The fluid machine of claim 2 wherein said secondary vane is pivotally coupled to a carrier ring, so that said secondary vane is pivotal about a second pivotal axis perpendicular to the axis of rotation of said carrier ring causing said secondary vane to reciprocate between relatively open and closed positions as said secondary vane is rotated about said primary axis by said first shaft; the axis of rotation of said carrier ring being oriented at an oblique angle in relation to said primary axis of said first shaft.

4. The fluid machine of claim 3 wherein said carrier ring is an exterior ring mounted in said wall of said housing.

5. The fluid machine of claim 3 further comprising a second shaft that extends into said interior of said housing opposite said first shaft, said second shaft having a spherical portion about which said primary vane rotates and wherein said carrier ring is rotatably carried on said spherical portion of said second shaft.

6. The fluid machine of claim 5 wherein a portion of said first shaft is extended into said spherical portion of said second shaft to provide rigidity to the internal structure of the fluid machine.

7. The fluid machine of claim 5 wherein a portion of said spherical portion of said second shaft is extended into said first shaft to provide rigidity to the internal structure of the fluid machine.

8. The fluid machine of claim 5 wherein said second shaft is adjustably mounted to said housing so that said second shaft is oriented in various fixed positions, and further comprising;

an adjustable vane guide bearing member disposed within said housing, wherein the adjustable vane guide bearing member oscillates said secondary vane between relatively open and closed positions relative to said primary vane in response to rotation of said primary vane, varying the point during rotation of said first shaft and said primary vane at which said secondary vane reaches the relatively open and closed positions relative to said housing and said port opening so that communication of said port opening with said chamber is adjusted and therefore the fluid flow volume and/or direction is adjusted.

9. A method for simultaneously flowing a first fluid and a second fluid through the same fluid machine in which one fluid can be compressible and one incompressible comprising the steps of:

providing a housing having a wall defining a generally spherical interior, the housing having at least one port opening in communication with said interior of said housing through which fluid from a fluid source is allowed to flow;

providing a first shaft mounted for rotation relative to said housing about a primary axis, wherein at least a portion of said first shaft extends through said housing wall;

providing at least one primary vane disposed within the interior of the housing that rotates about said primary axis;

providing at least one secondary vane disposed within the interior of the housing and mounted to said primary vane on a first pivotal axis;

rotating said primary vane about said primary axis with said secondary vane pivotally oscillating between alternating relatively open and closed positions with respect to said primary vane, the housing, the primary vane, and the secondary vane defining a fluid chamber for containing fluid within the housing interior having a volume that varies as the primary vane is rotated about the primary axis;

wherein said at least one port opening is adjustable and has a first opening in continuous fluid communication with an approaching closing chamber for pumping incompressible fluids but is changed to a second opening to convert said fluid machine to a compressor for compressible fluids.

10. The method of claim 9 wherein said change of port opening is accomplished by a port insert.

11. The method of claim 9 wherein said secondary vane is pivotally coupled to a carrier ring, so that said secondary vane is pivotal about a second pivotal axis perpendicular to the axis of rotation of said carrier ring causing said secondary vane to reciprocate between relatively open and closed positions as said secondary vane is rotated about said primary axis by said first shaft; the axis of rotation of said carrier ring being oriented at an oblique angle in relation to said primary axis of said first shaft.

12. The method of claim 11 wherein said carrier ring is provided as an exterior ring mounted in said wall of said housing.

13. The method of claim 11 further comprising the step of providing a second shaft that extends into said interior of said housing opposite said first shaft, said second shaft having a spherical portion about which said primary vane rotates and wherein said carrier ring is rotatably carried on said spherical portion of said second shaft.

14. The method of claim 13 further comprising extending a portion of said first shaft into said spherical portion of said second shaft to provide rigidity to the internal structure of the fluid machine.

15. The method of claim 13 wherein said second shaft is adjustably mounted to said housing so that said second shaft is oriented in various fixed positions, and further comprising the step of:

moving said second shaft from a first fixed position to a second fixed position to vary the point at which the secondary vane reaches the relatively open and closed positions relative to the port so that the degree of communication of the port with the fluid chamber defined by the primary and secondary vanes is adjusted to vary the fluid flow through the port.

16. The method of claim 13 further comprising extending a portion of said spherical portion of said second shaft into said first shaft to provide rigidity to the internal structure of the fluid machine.

* * * * *